US007603858B2

(12) United States Patent
Bennett

(10) Patent No.: US 7,603,858 B2
(45) Date of Patent: Oct. 20, 2009

(54) HARMONIC ENGINE

(75) Inventor: Charles L. Bennett, Livermore, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 278 days.

(21) Appl. No.: 11/801,987

(22) Filed: May 11, 2007

(65) Prior Publication Data

US 2008/0276615 A1 Nov. 13, 2008

(51) Int. Cl.
*F01B 29/10* (2006.01)

(52) U.S. Cl. ..... 60/517; 60/650; 60/682

(58) Field of Classification Search ..... 60/517–526, 60/650, 682

See application file for complete search history.

(56) References Cited

U.S. PATENT DOCUMENTS

| | | | | |
|---|---|---|---|---|
| 14,690 | A | | 4/1856 | Ericsson |
| 1,038,805 | A | | 9/1912 | Webb |
| 1,306,865 | A | | 6/1919 | Stoddard |
| 3,708,979 | A | | 1/1973 | Bush et al. |
| 4,008,574 | A | | 2/1977 | Rein |
| 4,183,219 | A | * | 1/1980 | Vargas ..... 60/682 |
| 4,327,550 | A | * | 5/1982 | Knoos ..... 60/522 |
| 4,342,448 | A | | 8/1982 | Wallis |
| 5,058,538 | A | | 10/1991 | Erickson et al. |
| 5,148,066 | A | | 9/1992 | Beale et al. |
| 5,261,358 | A | | 11/1993 | Rorke |
| 5,634,340 | A | * | 6/1997 | Grennan ..... 60/652 |
| 6,062,181 | A | | 5/2000 | von Gaisberg et al. |
| 6,302,068 | B1 | | 10/2001 | Moyer |
| 6,394,416 | B2 | | 5/2002 | von Gaisberg |
| 6,470,683 | B1 | | 10/2002 | Childs et al. |

* cited by examiner

*Primary Examiner*—Hoang M Nguyen
(74) *Attorney, Agent, or Firm*—James S. Tak; John H. Lee

(57) ABSTRACT

A high efficiency harmonic engine based on a resonantly reciprocating piston expander that extracts work from heat and pressurizes working fluid in a reciprocating piston compressor. The engine preferably includes harmonic oscillator valves capable of oscillating at a resonant frequency for controlling the flow of working fluid into and out of the expander, and also preferably includes a shunt line connecting an expansion chamber of the expander to a buffer chamber of the expander for minimizing pressure variations in the fluidic circuit of the engine. The engine is especially designed to operate with very high temperature input to the expander and very low temperature input to the compressor, to produce very high thermal conversion efficiency.

35 Claims, 10 Drawing Sheets

HARMONIC ENGINE

I. FEDERALLY SPONSORED RESEARCH OR DEVELOPMENT

The United States Government has rights in this invention pursuant to Contract No. W-7405-ENG-48 between the United States Department of Energy and the University of California for the operation of Lawrence Livermore National Laboratory.

II. BACKGROUND OF THE INVENTION

A. Technical Field

This invention relates to heat powered engines, and more particularly to a highly efficient form of heat powered, reciprocating-piston, harmonically acting engine having, in one embodiment, harmonic oscillator valves automatically controlling working fluid flow into and out of an expander at a resonant frequency, and in another embodiment, a shunt channel connecting a buffer chamber of the expander to the outlet of an expansion chamber of the expander, to minimize pressure perturbation in the engine fluidic circuit.

B. Description of the Related Art

Heat powered engines are known in which heat is supplied externally of the working cylinders rather than internally, in contrast to internal combustion engines. In prior art circuital flow-type (closed cycle) heat powered engines, a working fluid flows in a loop sequentially through a compressor, a heater, an expander, a cooler and finally back to the compressor. In an open cycle version, air is the working fluid and the ambient atmosphere performs the role of the cooler. Optionally, a heat interchanger transfers heat from the working fluid flowing between the expander and the cooler to the working fluid flowing between the compressor and the heater.

An early example of such a heat powered engine is described in U.S. Pat. No. 14690, entitled "Air Engine" by John Ericsson. A schematic illustration of this type of engine, but drawn with modernized mechanisms to facilitate comparison with the present invention, is shown in FIG. 1. This is an open cycle, heat powered engine having a single cylinder 57 with a single reciprocating piston dividing the internal cylinder volume into an expander chamber 54 and a compressor chamber 52. Incoming air 51 is drawn into compressor chamber 52 and raised in pressure, then sent to heater 53 and raised in temperature, then admitted to expander chamber 54 and dropped in pressure, and finally outgoing air 55 is released back to the ambient atmosphere. A heat interchanger 56 is provided to transfer some of the heat of the outgoing air to the pressurized air emerging from the compressor on its way to the heater. The arrows in FIG. 1 indicate the direction of flow of the air during the upstroke of the piston in this engine. However, a drawback of this single cylinder arrangement is the significant flow of heat from the high temperature expander chamber to the low temperature compressor chamber via the cylinder wall and the piston, which incurs a significant loss of thermal efficiency.

In U.S. Pat. No. 3,708,979 to Bush et al, entitled "Circuital Flow Hot Gas Engines," an improved form of closed cycle, hot gas engine is described that provides separate cylinders for the expander and compressor, and thus avoids the "short circuit" flow of heat between the expander and compressor previously described. A schematic illustration of an engine arrangement similar to the Bush reference is shown in FIG. 2 having valves in the gas flow circuit which define four separate volumes (when all valves closed) of gas and which control the flow of gas through the four volumes. These four volumes include the volume in the expander, the volume in the compressor, the transport volume from the compressor exhaust to the expander intake via the heater, and the transport volume from the expander exhaust to the compressor intake via the cooler. At various phases of the engine cycle, different combinations of these four volumes are placed in fluidic communication. For example, FIG. 2 illustrates one particular phase in the engine cycle in which the volume within the expander, the transport volume that passes through the cooler, and the volume within the compressor are all contiguous. Arrows in this figure indicate the direction of the gas flow at this particular phase. In this manner, as suggested in the Bush reference, the valves in the gas flow circuit provide a means for isolating the portion of the gas mass involved in expansion and compression, from the portion of the gas involved in exchanging heat with heaters or coolers. Thus very efficient heat transfer can be achieved without attenuation of the pressure swings involved in gas expansion and compression inside of the working cylinders, in sharp contrast to the case with Stirling engines.

However, considering the variable rates of flow of the gas through such a circuit, the mass contained within each of the four distinguishable volumes varies through the engine cycle. As a result, pressure variations in the fluid circuit are produced that may be detrimental to the thermal efficiency of the engine. In order to minimize the detrimental effect of these pressure variations, the Bush reference teaches the use of header volumes, both at the expander inlet 58 and at the expander outlet 59. These header volumes, however, need to be substantially larger than the displacements of the compressor and expander. In rough approximation, in order to reduce the undesirable pressure deviations to the 1% level, the header volumes need to be approximately 100 times greater than the working cylinder volume throughput per cycle. Since the volume throughput associated with the high pressure side is much less than for the low pressure side, the header volume at the exit of the expander, in particular, entails a significant engine mass and volume penalty in order to achieve high efficiency.

Furthermore, the use of an expander cross head linkage 60 and a separate compressor cross head linkage 61, may make the frictional power loss in the system greater than necessary. Since the full power developed by the expander is transmitted to the crankshaft linkage 62, the bearing stresses may also be greater than necessary. Finally, the extra mechanisms associated with the extra cross head entail greater expense and less reliability than would be the case with a single cross head In U.S. Pat. No. 1,038,805 to Webb, entitled "Hot Air Engine," a tandem arrangement of working cylinders for air engines is disclosed. An illustration of an engine arrangement similar to the Webb reference is provided as FIG. 3 showing two separate cylinders for the compressor 63 and the expander 64, with the compressor piston connected to and sharing a common piston rod with the expander piston, but otherwise thermally isolated from each other to enable greater thermal efficiency. The use of a single cross head 65 to serve two cylinders is also advantageous as there are fewer rotating mechanisms. However, similar to the Bush patent, pressure swings in the fluid volume linking the two tandem cylinders of FIG. 3 can produce degradation in the thermal efficiency associated with the fact that the rate at which air is expelled from the compressor does not necessarily match the rate at which air is optimally ingested into the expander.

Furthermore, one of the most complicated and expensive features in the prior art of heat powered engines is the expander valve actuation mechanism. While the Webb reference teaches the use of automatic valves (such as reed valves, or the spring loaded poppet valves shown in FIG. 3) for controlling the flow of working fluid to the compressor, in contrast it teaches the use of "a slide or other valve, not shown, for controlling admission and exhaust" from the expander. FIG. 3 shows a sliding "Dee" valve 66 of a form well known in the art of steam engines. However, because of the sliding contact, such Dee valves must be lubricated to prevent undo friction, and are not able to function reliably at high speed and temperature. In contrast, poppet valves, such as those described in the Bush reference, avoid sliding contact, and are very highly developed in the field of internal combustion engines. Such poppet valves typically involve components such as cams, tappets, rockers and followers, as in conventional automobile engines, or pneumatic actuators, such as described by the Bush reference, or may involve electromagnetic actuators. With regard to the Bush reference in particular, at least three different means are disclosed by which the expander inlet valve may be opened automatically in response to either the increasing pressure within the expander cylinder as the expander piston approaches the top of the cylinder, or by actual contact with the expander piston itself. However, Bush does not teach how the expander inlet and outlet valves may be made to act fully automatically, as has long been known in the art for compressor valves.

In U.S. Pat. No. 6,062,181 to von Gaisberg et al, entitled "Arrangement for an electromagnetic valve timing control," and in U.S. Pat. No. 6,302,068 to Moyer, entitled "Fast acting engine valve control with soft landing," and in U.S. Pat. No. 6,394,416 to von Gaisberg, entitled "Device for operating a gas exchange valve," the use of poppet valves partially actuated by springs is taught, with solenoids activated to open and/or to close the valves. In U.S. Pat. No. 5,058,538 to Erickson et al, entitled "Hydraulically propelled pneumatically returned valve actuator", hydraulic and pneumatic activators are taught, instead of the solenoids used in the three previously mentioned cases. However, this prior art does not teach the use, or particular advantages of resonantly acting, harmonic oscillator valves in the expander of an external heat powered engine.

Thus there is a need to overcome the thermal inefficiency and pressure hysteresis factors associated with the known arrangements shown in the prior art, as well as overcome the other limitations of the prior art, including those associated with expander valves and their operation.

III. SUMMARY OF THE INVENTION

One aspect of the present invention includes an engine comprising: a reciprocating-piston expander comprising: an expander cylinder; an expander piston head axially slidable in said expander cylinder and together enclosing an expansion chamber; a piston rod connected at one end to the expander piston head; an inlet valve for controlling the flow of working fluid into the expansion chamber to effect a power stroke of the expander, said inlet valve being a harmonic oscillator having an equilibrium position outside the expansion chamber so that the inlet valve is open at equilibrium and displaceable to a closed position against an equilibrium restoring force; latch means for automatically re-latching the inlet valve in the closed position after being unlatched to experience a harmonic oscillation; an outlet valve for controlling the flow of working fluid out from the expansion chamber during a return stroke of the expander, said outlet valve being a harmonic oscillator having an equilibrium position inside the expansion chamber so that the outlet valve is open at equilibrium and displaceable to a closed position against an equilibrium restoring force; an intake header connectable to a pressurized fluid source for channeling pressurized working fluid into the expansion chamber via the inlet valve; and an exhaust header for channeling working fluid exhausted out from the expansion chamber via the outlet valve; and periodic return means for effecting the return stroke of the expander after each power stroke.

Another aspect of the present invention includes an engine comprising: a reciprocating-piston expander comprising: an expander cylinder enclosing a cylindrical volume; an expander piston head axially slidable in said expander cylinder and dividing the cylindrical volume into an enclosed expansion chamber and an enclosed buffer chamber; a piston rod connected at one end to the expander piston head and axially extending out from the expander cylinder through a closed end thereof; an inlet valve for controlling the flow of working fluid into the expansion chamber to effect a power stroke of the expander, said inlet valve being a harmonic oscillator having an equilibrium position outside the expansion chamber so that the inlet valve is open at equilibrium and displaceable to a closed position against an equilibrium restoring force; latch means for automatically re-latching the inlet valve in the closed position after being unlatched to experience a harmonic oscillation; an outlet valve for controlling the flow of working fluid out from the expansion chamber during a return stroke of the expander, said outlet valve being a harmonic oscillator having an equilibrium position inside the expansion chamber so that the outlet valve is open at equilibrium and displaceable to a closed position against an equilibrium restoring force; an intake header connectable to a pressurized fluid source for channeling pressurized working fluid into the expansion chamber via the inlet valve; and an exhaust header for channeling working fluid exhausted out from the expansion chamber via the outlet valve; and a shunt channel fluidically connecting the buffer chamber to the exhaust header so that, upon operating said outlet valve to exhaust working fluid from the expansion chamber, the expansion chamber and the buffer chamber are in fluidic communication; periodic return means for effecting the return stroke of the expander after each power stroke; a compressor as the pressurized fluid source having a compression chamber, a compressor inlet leading into the compression chamber, and a compressor outlet leading out from the compression chamber; a fluidic channel connecting the compressor outlet to the intake header of the expander for supplying pressurized working fluid thereto; throttle valve means for controlling the flow rate of working fluid entering the compressor based on an absolute temperature ratio of the working fluid leaving the expander and the working fluid entering the compressor; and throttle valve means for controlling the flow rate of working fluid coming from the exhaust header of the expander.

Another aspect of the present invention includes an engine comprising: a reciprocating-piston expander comprising: an expander cylinder enclosing a cylindrical volume; an expander piston head axially slidable in said expander cylinder and dividing the cylindrical volume into an enclosed expansion chamber and an enclosed buffer chamber; a piston rod connected at one end to the expander piston head and axially extending out from the expander cylinder through a closed end thereof; an inlet valve for controlling the flow of working fluid into the expansion chamber to effect a power stroke of the expander; an outlet valve for controlling the flow of working fluid out from the expansion chamber during a return stroke of the expander; an intake header connectable to a pressurized fluid source for channeling pressurized working fluid into the expansion chamber via the inlet valve; and an exhaust header for channeling working fluid exhausted out from the expansion chamber via the outlet valve; and a shunt channel fluidically connecting the buffer chamber to the exhaust header so that, upon operating said outlet valve to exhaust working fluid from the expansion chamber, the expansion chamber and the buffer chamber are in fluidic communication; and periodic return means for effecting the return stroke of the expander after each power stroke.

Another aspect of the present invention includes an engine comprising: an expander having an expansion chamber, an expander inlet leading into the expansion chamber, an expander outlet leading out from the expansion chamber, valve means for controlling flow of working fluid into and out of the expansion chamber via the expander inlet and the expander outlet, respectively; a compressor having a compression chamber, a compressor inlet leading into the compression chamber, a compressor outlet leading out from the compression chamber, and valve means for controlling flow of working fluid into and out of the compression chamber via the compressor inlet and compressor outlet, respectively; a fluidic channel connecting the compressor outlet to the expander inlet for supplying pressurized working fluid from the compressor to the expander; throttle valve means for controlling the flow rate of working fluid entering the compressor inlet based on an absolute temperature ratio of the working fluid leaving the expander and the working fluid entering the compressor; and throttle valve means for controlling the flow rate of working fluid coming from the exhaust header of the expander.

IV. BRIEF DESCRIPTION OF THE DRAWINGS

The accompanying drawings, which are incorporated into and form a part of the disclosure, are as follows:

FIG. 1 is a schematic view of a prior art air engine disclosed in U.S. Pat. No. 14690 to Ericsson.

FIG. 2 is a schematic view of a prior art heat powered engine disclosed in U.S. Pat. No. 3,708,979 to Bush et al.

FIG. 3 is a schematic view of a prior art tandem compound hot air engine similar to that disclosed in U.S. Pat. No. 1,038,805 to Webb.

Figure 10:
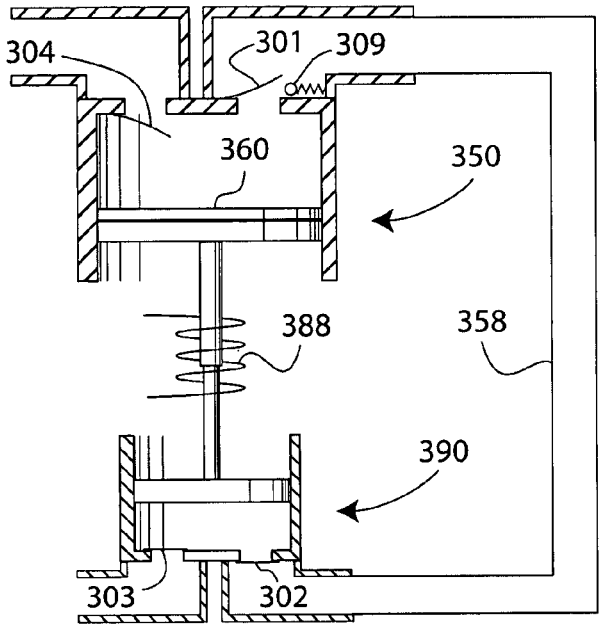

FIG. 10 is a partial view of a second embodiment of the present invention with reed valves in both the expander and the compressor. The position of the reeds in this figure corresponds to the fully relaxed state for all four reeds. This figure also illustrates a third exemplary embodiment, having a linear induction motor.

Figure 11:
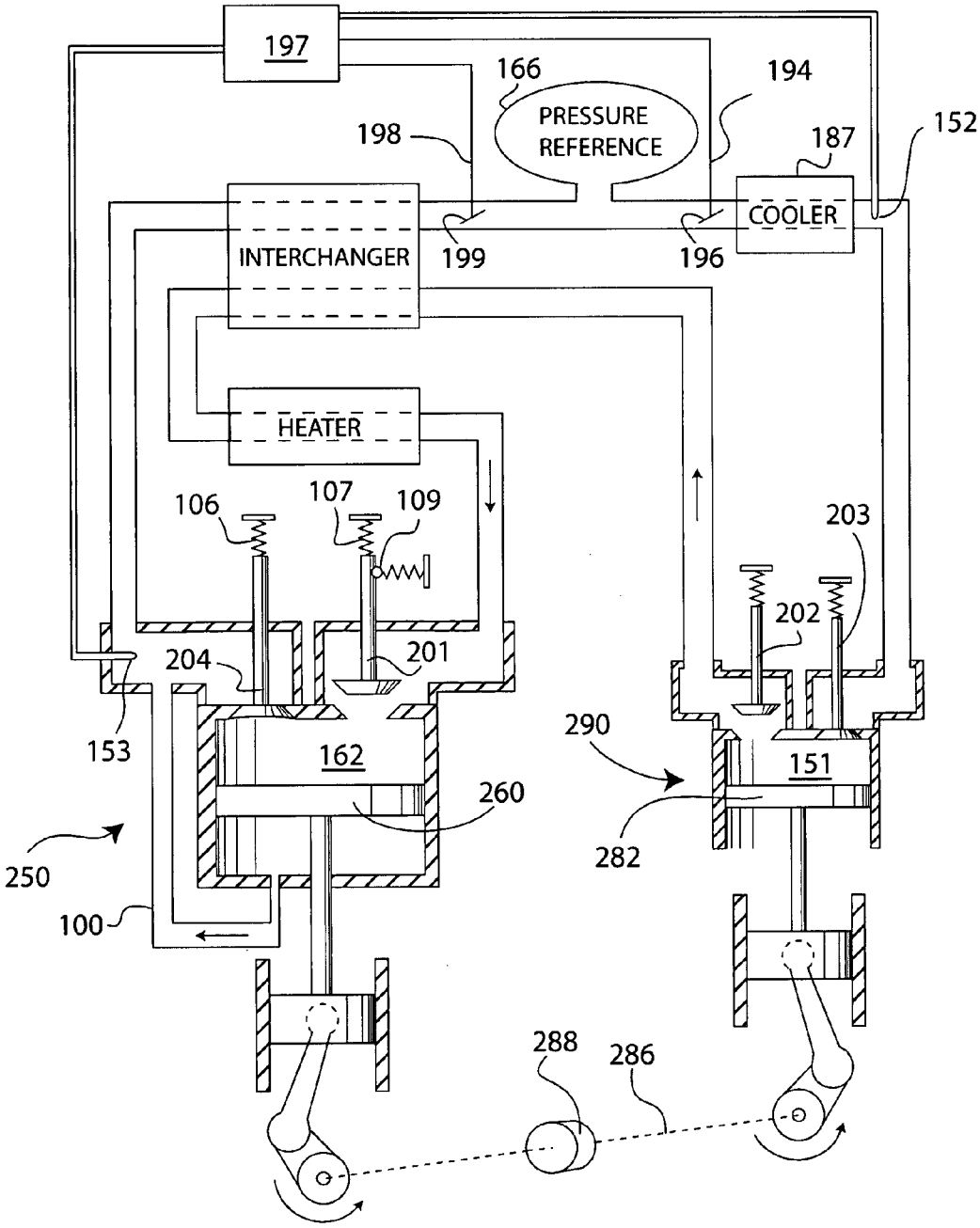

FIG. 11 is a schematic cross-sectional view of a fourth exemplary embodiment of the present invention, having a parallel arrangement of the expander and the compressor.

Figure 12:
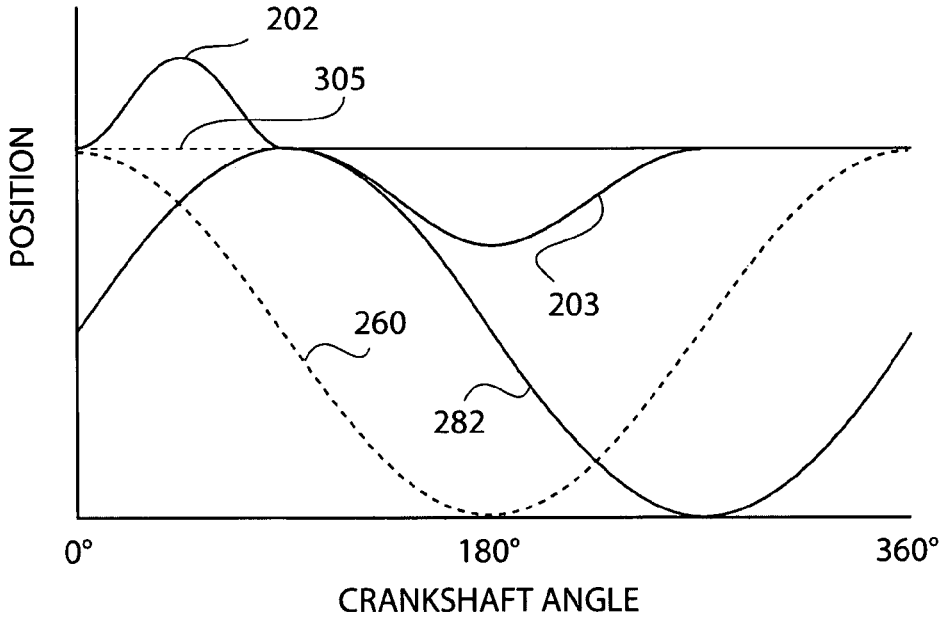

FIG. 12 is a graph showing the compressor valve and compressor piston positions of the steady running, parallel embodiment of the harmonic engine illustrated in FIG. 11, with the compressor valve and compressor piston positions shown in solid lines, and with the expander piston position shown as a dashed line for reference.

Figure 13:
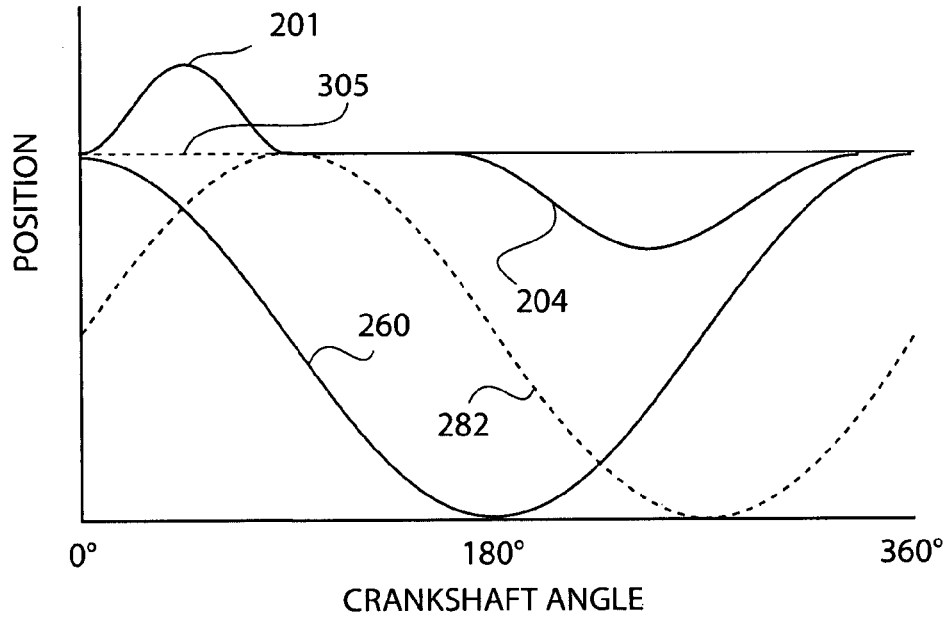

FIG. 13 is a graph showing the expander valve and expander piston positions of the steady running, parallel embodiment of the engine of FIG. 11, with the expander valve and expander piston positions shown in solid lines, and the compressor piston position shown as a dashed line for reference.

Figure 14:
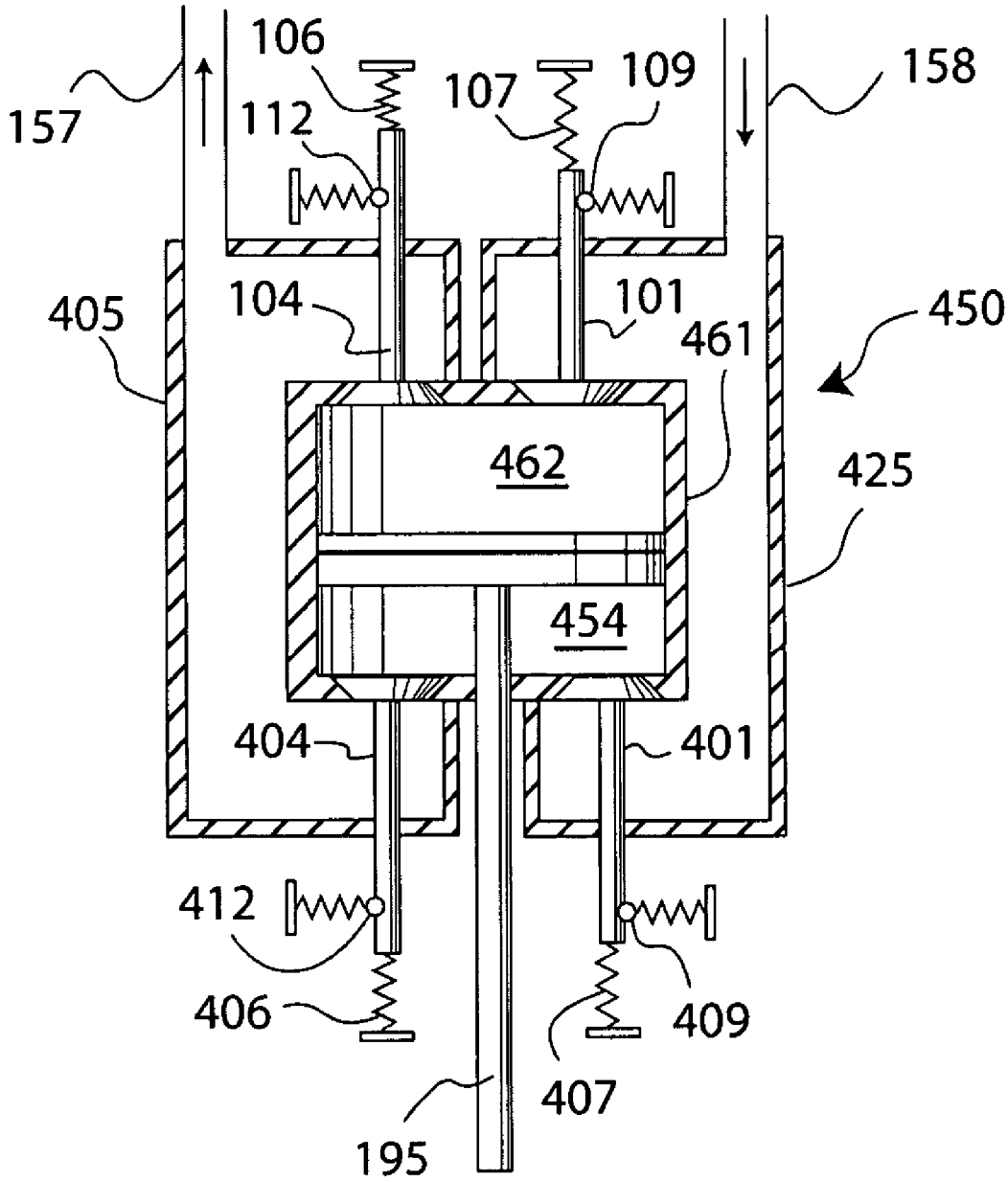

FIG. 14 is a schematic cross-sectional partial view of a fifth exemplary embodiment of the present invention comprising a double acting expander.

V. DETAILED DESCRIPTION

Generally, the present invention is a high efficiency, heat powered reciprocating-piston engine designed to maximize thermal efficiency by minimizing thermal losses and pressure hysteresis losses as much as reasonably achievable, as well as enabling automatic self-acting expander valve actuation for simplified and cost-effective operation. The engine expander and compressor cylinders of the engine are separated in order to minimize the heat loss from the hot end to the cold end of the engine. In particular, the separation enables the harmonic engine to operate at very high thermal efficiency by allowing a high ratio between the hot side temperature and the cold side temperature in the engine. By virtue of the extreme temperature capability of this engine, thermal efficiency substantially exceeding 60%, the current state of the art value attained with gas turbine plus steam turbine combined cycle engines, is enabled. Experiments with a laboratory prototype based on the engine described herein have shown that this configuration has the capability to exceed an indicated efficiency of 60%.

Furthermore, the present invention preferably uses resonant harmonic oscillator valves for controlling working fluid flow into and out of the expander, which has typically been mechanically or otherwise controlled externally (e.g. by cams, or driven by hydraulic, pneumatic or solenoidal means), to simply the expander valve actuation mechanism and its operation, and improve cost effectiveness. With regard to this aspect, the present invention uses harmonic oscillators as self-acting automatic valves, and as such is characterized as a harmonic engine. It is appreciated that the term "harmonic engine" can be used to characterize either the simple combination of an expander (for producing the power stroke) driven by a supply of pressurized working fluid and a periodic or cyclical means for effecting the return stroke, or a self-contained power generating system having additional components such as a compressor, heater, cooler, fluidic conduits, etc.

Figure 1:
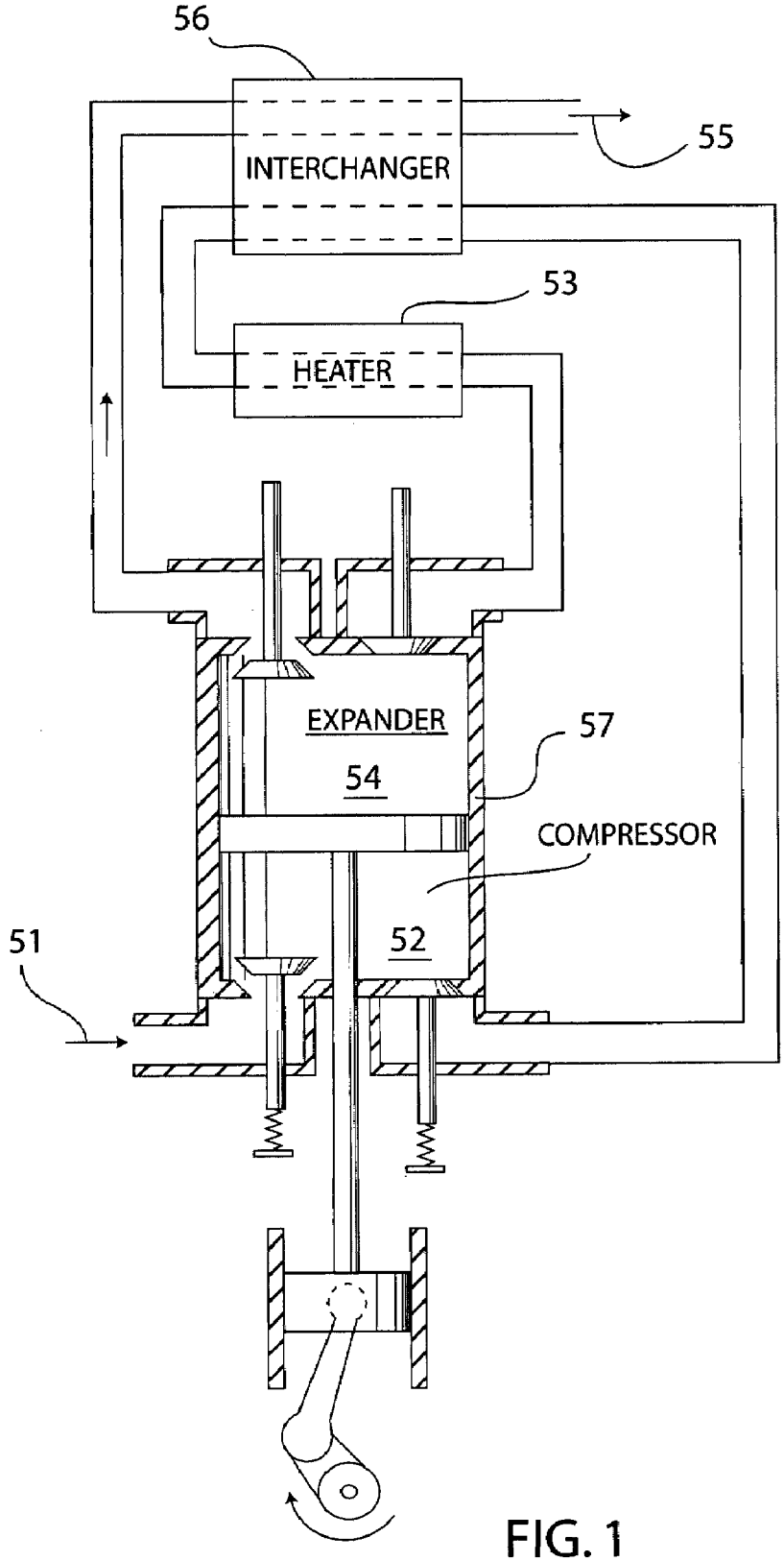
FIG. 1 (PRIOR ART)
Figure 2:
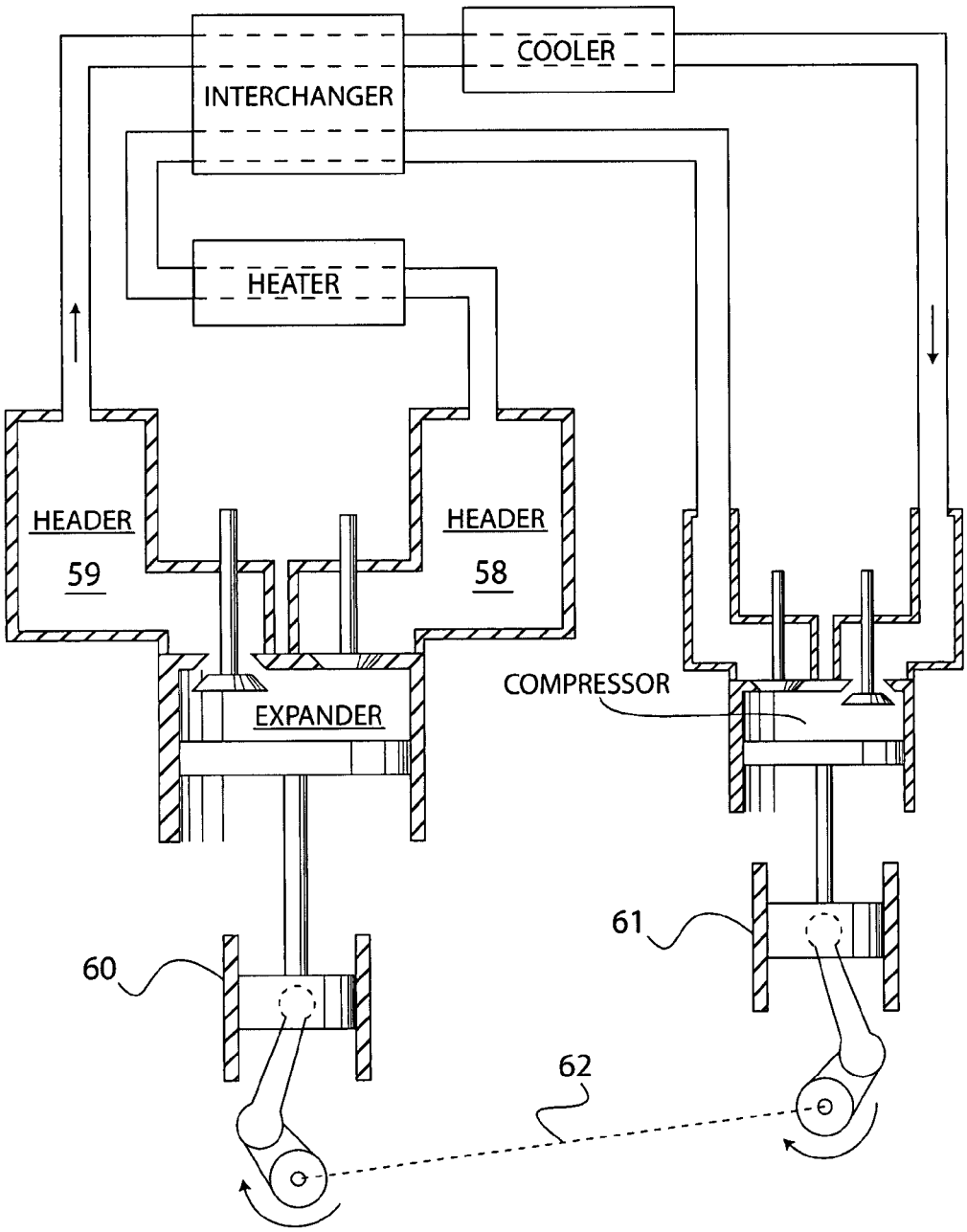
FIG. 2 (PRIOR ART)
Figure 3:
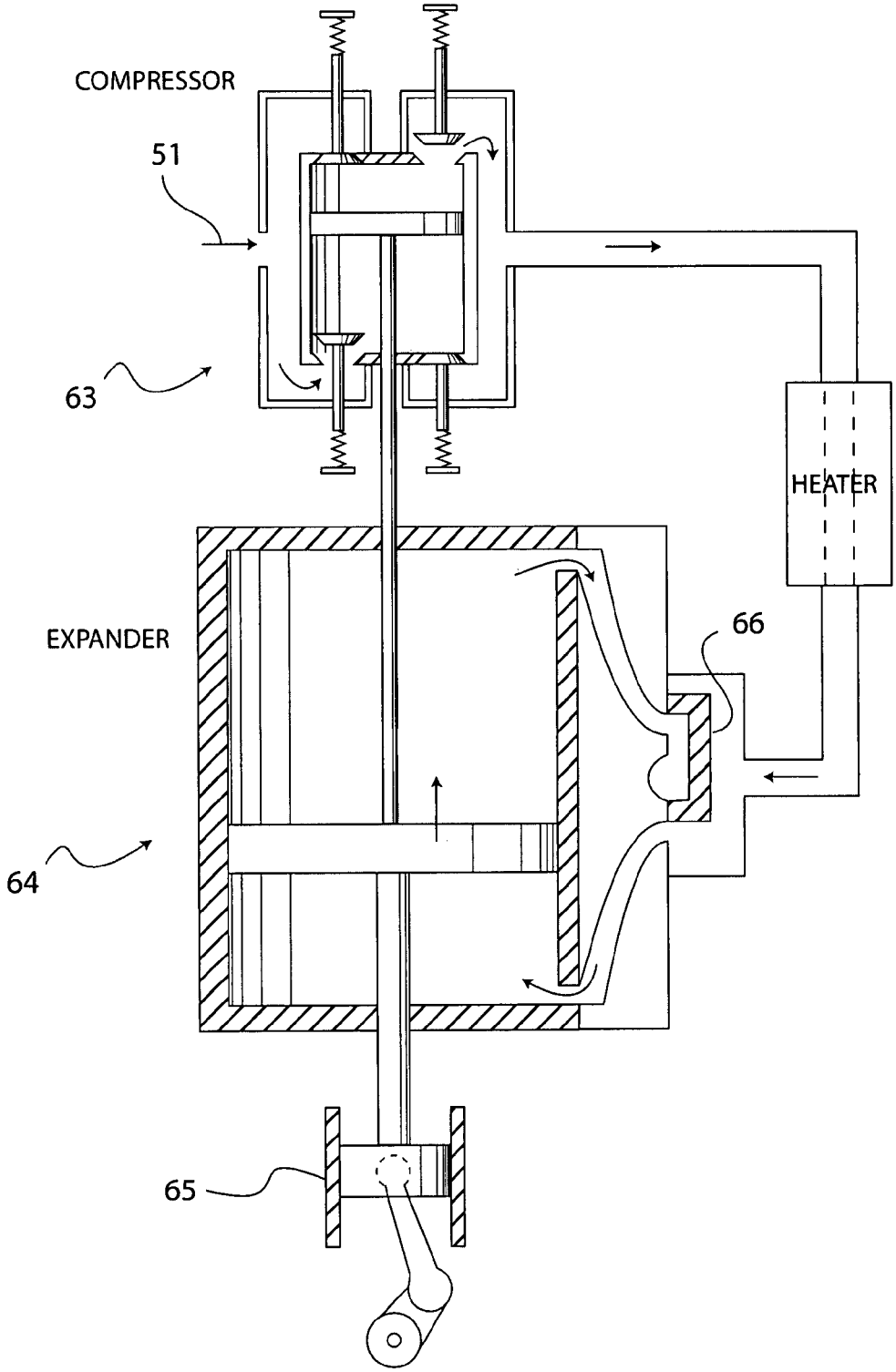
FIG. 3 (PRIOR ART)
Figure 4:
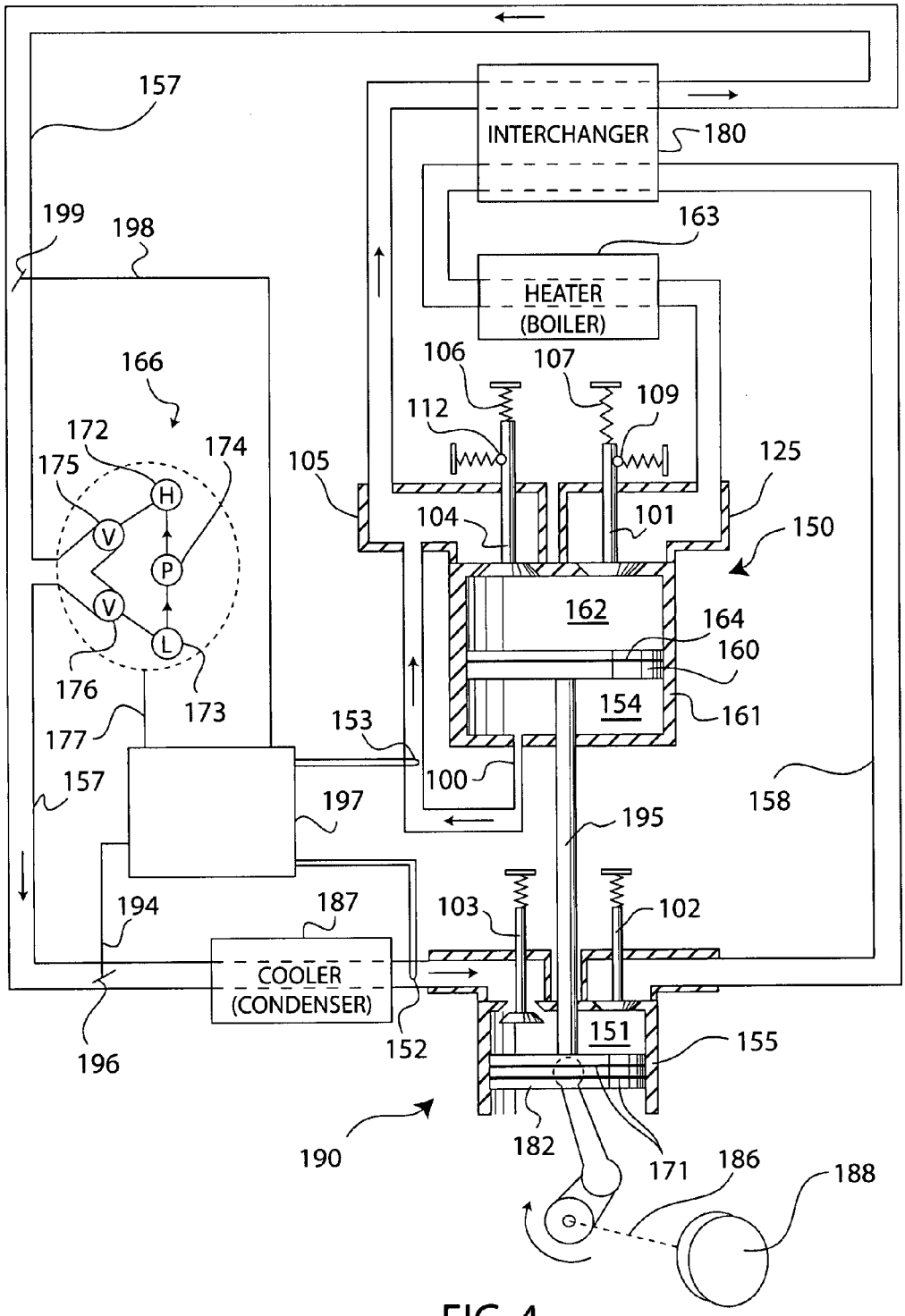
FIG. 4 is a schematic cross-sectional view of a first exemplary embodiment of the harmonic engine of the present invention, having a tandem arrangement.
Figure 5:
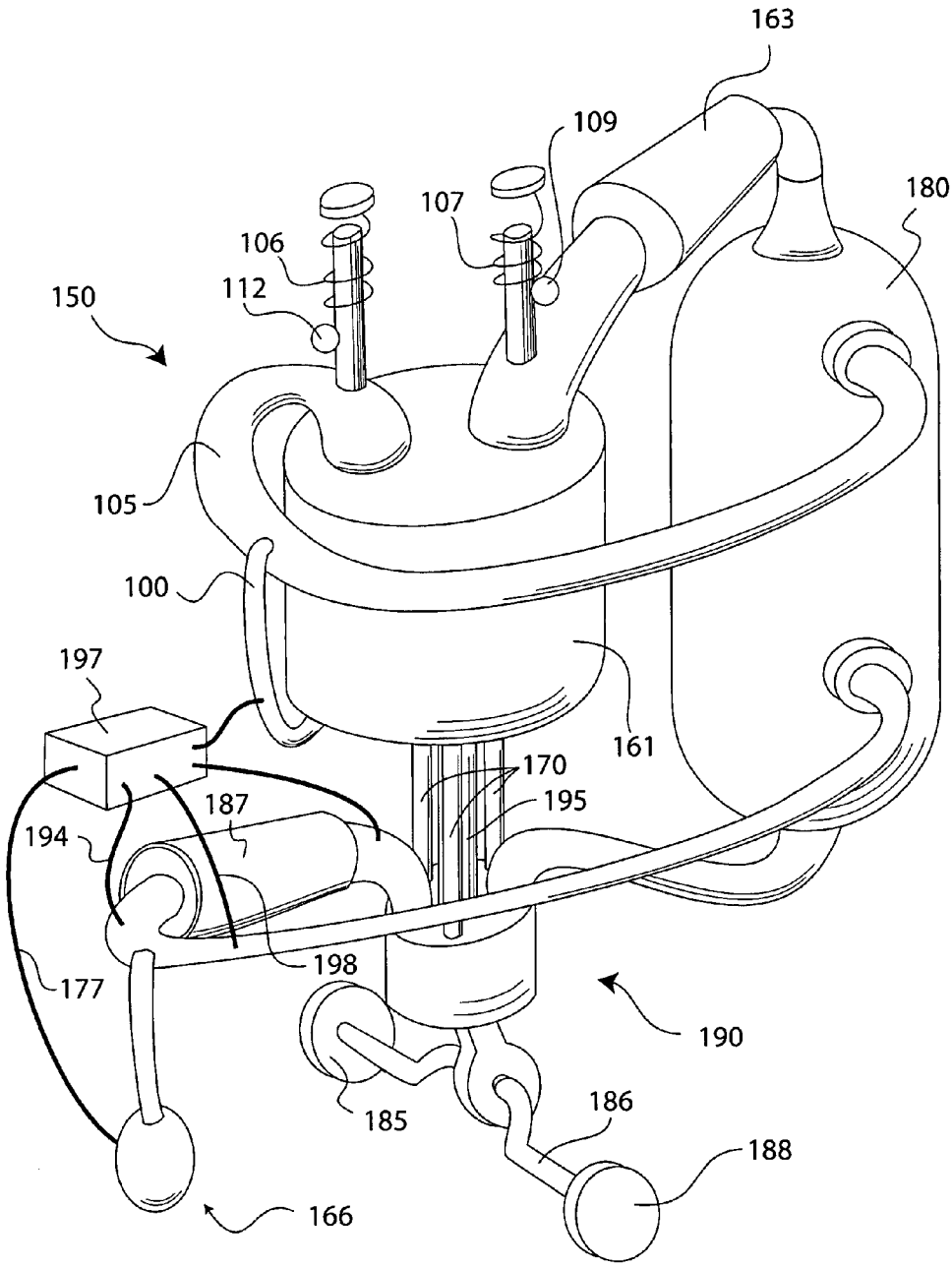
FIG. 5 is a perspective view of the harmonic engine of FIG. 4.

Turning now to the drawings, FIGS. 4 and 5 together show a first exemplary system having various component parts and sub-assemblies which together as a whole or in various sub-combinations may be characterized as the "harmonic engine" of the present invention. Generally, the system is shown having the following components and sub-assemblies: a reciprocating-piston expander assembly 150 with valves 101 and 104 for controlling flow into and out of an expander chamber 162 and a shunt line 100 fluidically connecting an exhaust header duct 105 to a buffer chamber 154; a reciprocating-piston compressor assembly 190 arranged to operate in tandem with the expander assembly via a piston rod 195 and having valves 103 and 102 for controlling flow into and out of a compression chamber 151; fluidic channels 157 and 158 for transporting a working fluid between the compressor assembly and the expander assembly; a heater 163 for heating the working fluid prior to entering the expander assembly; a cooler 187 for cooling the working fluid prior to entering the compressor assembly; a heat interchanger 180 for exchanging heat between the fluidic channels 157 and 158; and a crank assembly with crankshaft 186 operably connected to the compressor piston head 182 for converting reciprocating motion into rotary power output as conventionally known in the art. Furthermore, a pressure reference assembly 166 is also provided for varying the pressure of the working fluid in the harmonic engine to control the power output from the engine. Each of these components and sub-assemblies are discussed in detail as follows.

Expander Assembly

The reciprocating-piston expander assembly 150 is shown in FIG. 4 having an expander cylinder 161, an expander piston head 160 dividing the internal volume of the expander cylinder into an enclosed expansion chamber 162 above the piston head and an enclosed buffer chamber 154 below the piston head, and valves 101 and 104 leading into and out of the expansion chamber 162, respectively. Preferably, as shown in FIG. 4, flow ducts, such as expander intake header 125 and expander exhaust header 105, are provided to direct working fluid arriving from the fluidic channel 158 into the expander inlet at inlet valve 101, and to direct working fluid exhausted from the expander outlet at outlet valve 104 into the fluidic channel 157. Furthermore, shunt line 100 is shown connecting the buffer chamber 154 to the expander exhaust header 105. Most components of the expander assembly 150 are preferably constructed of high temperature compatible stainless steel, by virtue of resistance to oxidation at high temperature and low thermal conductivity. The single representative expander piston ring 164 shown surrounding the expander piston head 160 to contact the inner cylinder surface of the expander cylinder 161 is preferably a low porosity graphite, such as Poco graphite, that may be used in air beyond 500° C., and far higher in an inert atmosphere.

Fully Automatic Expander Valves

Expander valves 101 and 104 are shown in FIG. 4 as poppet valves. In particular, expander outlet valve 104 that controls the flow of working fluid out of expansion chamber 162 preferably has a conventional poppet valve arrangement commonly used in automobile engines with a chamfer that occludes from the inside out, i.e. the outlet valve 104 occludes when pulled away from the center of expander cylinder 161, and opens when pushed into the expander cylinder. In contrast, expander inlet valve 101 that controls the flow of working fluid into expansion chamber 162 preferably has a reversed chamfer arrangement which occludes from the outside in (similar to a conventional automotive wastegate valve known in the art), i.e. the inlet valve 101 occludes when pushed toward the expander cylinder 161, and opens when pulled away from the center of the expander cylinder.

Figure 6:
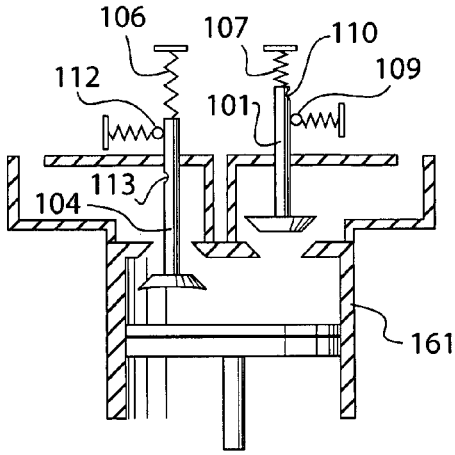
FIG. 6 is a partial view of the expander head of FIG. 4, showing the fully relaxed state of the automatic expander valves.

Furthermore, as shown in FIGS. 4-6, expander inlet valve 101 is connected to spring 107 to form a spring-mass system of a harmonic oscillator which, when displaced from its equilibrium position, experiences a restoring force proportional to the displacement according to Hooke's law, as known in the art. Similarly, expander outlet valve 104 is connected to spring 106 to form another spring-mass system characterized as a harmonic oscillator.

As shown in FIGS. 4 and 6 the expander valves 101 and 104 are arranged so that the valves are open (FIG. 6) when in their respective neutral/equilibrium positions, and closed (FIG. 4) when displaced from their respective neutral/equilibrium positions. In particular, for each of the automatic expander valves 101 and 104, the preferred neutral spring position is near half the desired maximum valve open position. When outlet valve 104 is in its neutral position, as shown in FIG. 6 with spring 106 relaxed and latch 112 disengaged from indent 113, it is opened approximately half as far as its maximum open state under steady running conditions. Similarly, when inlet valve 101 is in its neutral position with spring 107 relaxed and latch 109 disengaged from indent 110, the position of inlet valve 101 in this state represents approximately half of the fully opened lift height under steady running conditions. And when valve 101 is closed, as shown in FIG. 4, spring 107 is stretched with respect to its neutral position, and when valve 104 is closed, spring 106 is compressed with respect to its neutral position. The spring-loaded latches 109 and 112 are used to keep the expander valves 101 and 104, respectively, in the closed position until overcome by a sufficient change in pressure differential on opposite sides of the valves.

When the latches are released from the closed positions, it is appreciated that in the absence of working fluid flow past the valves and ignoring friction and the action of the latches, both valves 101 and 104 would execute simple harmonic oscillatory motion, at resonant frequencies determined by the valve masses and spring strengths, about the neutral positions displayed in FIG. 6. For inlet valve 101, there is normally a higher pressure acting on the outside surface of inlet valve 101 than on the interior surface facing the expansion chamber, and thus it is normally held shut by a combination of the engaged latch and this pressure difference. Similarly, for outlet valve 104, there is normally a higher pressure acting on the inside surface of outlet valve 104 than on the exterior surface, and thus it is normally held shut by a combination of the engaged latch and this pressure difference. However, when a sufficient change in the pressure differential is experienced, such as when the expander piston head nears top dead center for inlet valve 101, the latch 109 will release, thereby enabling the valve to experience a single oscillation during which inlet valve 101 is opened and then returned to be re-engaged by the latch 109 in the closed position. Similarly, when a sufficient change in the pressure differential is experienced by outlet valve 104 when the expander piston head nears bottom dead center, the latch 112 will release enabling the valve to experience a single oscillation during which outlet valve 104 is opened and then returned to be re-engaged by the latch 112 in the closed position. Because the release of the latches is caused exclusively by the change in pressure differential on opposite sides of each respective valve, this valve operation is characterized as being fully automatic, and the valves being fully automatic valves. As such, the use of cams, or other means of actively controlled valve actuating mechanism, is not necessary. This is in contrast to the case of semi-automatic valve operation discussed below.

It is appreciated that while various approximations and idealizations are used in the above description of the fluid flow and mechanical dynamics related to fully automatic valve operation, the design of an optimized real engine would typically require computational fluid dynamics and numerical integration of the equations of motion, by means well known in the art, to determine the precise and accurate specification of masses, spring constants, and component dimensions of the various moving parts and fluids involved in the fully automatic valve operation. It is further appreciated that while described as a mechanical mechanism, the latches could be embodied using magnetic, hydraulic, or pneumatic mechanisms or devices.

Compressor Assembly

The reciprocating-piston compressor assembly 190 shown in FIG. 4 is preferably of a form well known to those skilled in the art, and is shown having a compressor cylinder 155, a compressor piston head 182 positioned in the compressor cylinder 155 to form a compression chamber 151, and automatic valves 102 and 103. Similar to the expander assembly 150, header flow ducts provide connection to the fluidic conduits 157 and 158, and serve to lead/direct working fluid out to conduit 158, or in from conduit 157. Most components of the compressor assembly are preferentially constructed of aluminum, by virtue of the strength, corrosion resistance, lightness, and relatively low cost. And conventional metal rings 171 and splash oil lubrication from a sump may be used for the compressor piston.

As is well known and preferred for reciprocating compressors, an automatic valve 103 governs flow into compression chamber 151, while a second automatic valve 102 governs flow out of chamber 151. Valves 102 and 103 are conventional automatic compressor valves, activated by the flow of working fluid into and out of compression chamber 151. That is, valve 102 opens only when the pressure in expansion chamber 151 sufficiently exceeds the pressure on the external side of valve 102, while valve 103 opens only when the pressure in expansion chamber 151 has dropped sufficiently below the pressure on the external side of valve 103. For very high speed operation reed valves (as illustrated in FIG. 10) are preferred, since the mass that is moved in the actuation of the valve is only that of the reed material itself, and thus by proper design, it is feasible to have very rapid acting valves, with very little complexity or expense. However, many variations in the design of compressor valves are known, and almost any of the many forms that are suitable for use in compressors may be used for the present invention.

Expander and Compressor in Tandem

The reciprocating-piston expander assembly 150 and the reciprocating-piston compressor assembly 190 are shown in FIG. 4 arranged in tandem with and spaced from each other. In particular, the expander cylinder 161 and the compressor cylinder 155 are preferably structurally connected to and thermally isolated from each other by a suitable rigid structure, such as tripod 170 shown in FIG. 5. The thermal resistance of the tripod is preferably sufficiently great that only a negligible fraction of the supplied heat is lost by conduction from the hot side to the cold side of the engine. This tripod supports and positions the two cylinders and allows access to tighten the packing seals as needed.

Piston rod 195 is shown connecting expander piston head 160 to compressor piston head 182 so that work performed by the expansion of working fluid is transferred by piston rod 195 to the compressor piston head 182 in an axial direction and the compressor piston head moves in phase with the expander piston head. The length of piston rod 195 is suitably great so that the loss of heat by thermal conduction from the hot expander cylinder to the cold compressor cylinder through the material of the piston rod is negligible. With this tandem arrangement, the requisite side wall support for the reciprocating expander piston head is virtually nil, thus eliminating the need for liquid lubrication in the expander cylinder, and enabling very high temperature expander cylinder operation.

The tandem reciprocating motions of the expander piston head 160, the compressor piston head 182, and the piston rod 195 are preferably centered and supported by conventional shaft packing seals (not shown) at the bottom of the expander cylinder and at the top of the compressor cylinder (through which the piston rod 195 extends) by means well known in the art of tandem cylinders. In particular shaft packing seals on the expander cylinder and compressor cylinder allow piston rod 195 to reciprocate up and down without significant loss of pressure past the seals. In a closed cycle embodiment, an additional tube (not shown) surrounding piston rod 195 prevents loss of working fluid from the engine. Such packing seals are well known in the art, and many choices are available, but woven graphite material is particularly suitable. The packing material for both of the shaft seals is preferably a braided carbon fiber with graphite lubrication, such as the Style 98 material available from Garlock Sealing Technologies. This material is good up to 455° C. in air, 650° C. in steam, and is expected to be good far beyond 700° C. in a nitrogen or argon environment. This material is also suitable for use at temperatures as low as −200° C.

Fluidic Transport Channels

In FIGS. 4 and 5, the harmonic engine is shown as a closed system, such that working fluid is cycled between the compressor assembly 190 and the expander assembly 150. In particular, channel 158 fluidically connects the compressor outlet (at valve 102) to the expander inlet (at valve 101), and channel 157 fluidically connects the expander outlet (at outlet valve 104) to compressor inlet (at valve 103). It is appreciated, however, that an open system embodiment of the present invention is also possible such that fluidic channel 157 would not be necessary. In such an open system embodiment, air would be drawn from the ambient environment into the compressor inlet and exhausted from the expander outlet out to the ambient environment.

Heater

Heat is preferably supplied by heater 163 to the engine working fluid in fluidic channel 158 to further increase the temperature of the working fluid coming from the compressor. It is appreciated that the heat supplied by the heater 163 may be generated by the heater itself, or provided by any number of high temperature external heat sources coupled to the heater. For example, concentrated sunlight from a solar thermal heat collector, external combustion, chemical reaction, nuclear reactions (radioisotope decay heat), or heat transfer from a thermal energy storage medium, either with or without the use of a distinct heat transfer fluid, are all viable options in the present invention. Also as the volume of working fluid within the heater is separated by inlet valve 101 from the expander cylinder, and by valve 102 from the compressor cylinder, the heat transfer surface area may be made arbitrarily large relative to the dimensions of the expander, and thus the efficiency of heat transfer may be made arbitrarily high without degrading the work produced by the expander piston per cycle. Furthermore, the choice of materials for the heater is quite broad, as the mechanical stresses within the heater region may be made much less than in the expander cylinder itself. The highest temperature component in the engine is the heater. This component may advantageously be made of ceramic or a high temperature, high strength metal alloy, for applications involving extreme high temperatures.

Cooler

Working fluid is also preferably cooled in the harmonic engine by cooler 187 prior to entering the compressor assembly 190. The cooler 187 is preferably exposed or otherwise thermally coupled to the ambient environment. This is particularly advantageous when the ambient environment is a low temperature external heat sink, such as high altitude air, or with radiative coupling to cold sky/space which enables high thermodynamic efficiency. In cases with the provision of low temperature cooling, far below ambient temperature, it is appreciated that heater 163 is not explicitly required as the ambient environment may provide adequate heating to achieve high thermodynamic efficiency. It is also appreciated that in open cycle embodiments, for which the ambient atmosphere itself provides pressure reference 166, that cooler 187 is not explicitly required.

It is also appreciated that with a working fluid that may have a phase transition from gas to liquid at the lowest temperatures in the fluidic circuit, that the working fluid emerging from cooler 187 may be partially or wholly in the liquid state. It is appreciated that in this case, compressor 190 serves to increase the pressure of the working fluid, but with only minimal decrease in the volume of the working fluid. Such behavior is most familiar in the context of steam engines technology. In this context, the cooler is normally called a condenser, the heater is normally called a boiler, and the compressor is normally called a pump.

Heat Interchanger

A heat interchanger 180 is also shown provided in FIG. 4, which functions to heat the working fluid emerging from compressor chamber 151 using the hot working fluid output from expander chamber 162. In particular, the heat interchanger 180 shown in FIG. 5 is shown as a conventional, counter-flow shell and tube heat exchanger. High pressure working fluid flow from compressor assembly 190 to heater 163 flows up through the tubes inside of heat interchanger 180, while low pressure working fluid from the outlet of expander chamber 162 flows down through the shell portion of heat interchanger 180 to cooler 187. To promote efficient operation, the volume within the tube side of interchanger 180 and connected conduits is preferably significantly greater than the volume of working fluid admitted each stroke to expander chamber 162. This promotes substantially isobaric filling of expander chamber while inlet valve 101 is open. The interchanger assembly 180 and most components of expander assembly 150 are preferentially constructed of stainless steel, by virtue of the strength, relatively low cost, and corrosion resistance at the higher temperatures typically involved in the hot side of the engine.

Similarly, with an efficient heat exchanger, the volume within the shell and associated conduits tends to be significantly greater than the volume of working fluid admitted each stroke to compression chamber 151 and this tends to promote substantially isobaric filling of the compression chamber.

Working Fluid

The working fluid may either remain in gas phase throughout the engine working cycle, or may be in a liquid state in certain portions of the engine working cycle. Many options for the specific choice of working fluid are feasible, and each choice has its advantages and disadvantages for particular operating requirements. Air is the most readily available gaseous working fluid, and the only viable choice for an open cycle embodiment. Water is the most readily available phase-change working fluid, and is preferred for modest operating temperatures, between approximately 300 K and 600 K. Hydrogen gas features one of the highest thermal conductivities among gases, and this aspect enables the external heat exchangers to be relatively smaller, but also requires that the engine be approximately hermetically sealed to prevent loss of working fluid. Helium has almost as high a thermal conductivity as hydrogen, but is in addition an inert gas, and thus enables extremely high and or low operating temperatures, without corrosion or condensation. Finally, a vast number of organic compounds are available for use in an ORC (Organic Rankine Cycle) mode of operation of the present invention.

Crank Assembly for Power Output

FIGS. 4 and 5 also show a crank assembly including crankshaft 186 connected to the compressor piston head 182 in a conventional manner known in the art for converting reciprocating piston motion to rotary power output. As shown in FIG. 5, flywheel 185 is connected to the crankshaft 186 and serves to momentarily store some of the energy produced during the power stroke of expander piston head 160 to be returned during the return or exhaust stroke. In this manner, the inertial moment of the rotating flywheel functions to drive the expander piston head (and compressor piston head in the tandem arrangement) back toward the top dead center position to effectuate the return stroke. As alternatives, it is appreciated that, in place of the cross-head, crankshaft and flywheel illustrated in the figures, various other means that both extract energy from the downward power stroke of the expander piston head and return the piston head to TDC are feasible. These could include linear electric motor/generators (see FIG. 10) with integral magnetic springs, spring loaded water pumping cylinders connected to the piston rod, pneumatic gas compressors in which the role of the spring or flywheel is served by the springiness of the gas being compressed, or any other of a wide variety of linear to rotary conversion mechanisms with energy storage in a flywheel.

Starter Motor Generator

Furthermore, FIGS. 4 and 5 show an optional starting motor 188 operably connected to crankshaft 186 for starting the engine. Alternatively, the starting motor 188 may also be a generator for producing electrical power once the engine is running. When coupled to the electric power grid, starter motor generator 188 is preferably a squirrel cage induction motor compatible with the 60 Hz alternating current power in the United States. As is well known in the art, under low load conditions, such as when starting up, crankshaft 186 is driven to rotate at a frequency very nearly equal to an integer fraction (with the integer depending on the motor pole structure) of the power grid frequency. As the engine produces power, it overdrives motor 188, and instead generates electrical current that is forced to be in phase with the electric grid current. In this case, it is preferable for the resonant frequency of the expander inlet and outlet valve and spring assemblies to be near integer multiples of the desired electrical output power frequency.

Engine Operation

Operation of the fully automatic harmonic engine shown in FIGS. 4 and 5 is now described. Starting the cycle arbitrarily at the bottom left of FIG. 4, the working fluid passes through cooler 187 and through valve 103 into compression chamber 151. After emerging from cooler 187, the working fluid is at its lowest temperature point of the cycle, and may be in either liquid or gas phase or a mixture of both. After pressurization by the upward motion of piston head 182, working fluid flows through valve 102, through the tube side of interchanger 180, and is raised in temperature (nearly isobarically) by counter-flow heat exchange. Hot working fluid emerging from the tube side of interchanger 180 then enters heater 163 and is heated to the maximum temperature point in its cycle. After the heater, gaseous working fluid is admitted to expansion chamber 162 through inlet valve 101. After expansion in chamber 162, working fluid is released through outlet valve 104 back to the shell side of interchanger 180, where it gives up heat (nearly isobarically) to the counter-flowing working fluid originating from the compressor. At the bottom end (as seen in FIG. 5) of the shell side of interchanger 180, the working fluid exits to return to cooler 187 and completes the cycle.

On the up (return) stroke of expander piston head 160, working fluid is drawn into buffer chamber 154 through shunt channel 100. As the temperature of the working fluid in the buffer chamber 154 is only slightly lower than the temperature of the working fluid in expander chamber 162, and as the rate of change of the volume in buffer chamber 154 is approximately equal in magnitude and opposite in sign to the rate of change of the volume in expander chamber 162, while outlet valve 104 is open, there is little variation in the pressure of the working fluid within conduit 157 during the up stroke. In this manner, the shunt channel 100 enables pressure variations in the volume between the expander outlet and the compressor inlet to be minimized, so that pressure hysteresis losses may be lowered and the engine efficiency may be increased.

Similarly, on the down stroke, as the rate of decrease of the mass of working fluid in buffer chamber 154 is approximately equal to the rate of increase of mass of working fluid within compressor chamber 151, there is little variation in the pressure of the working fluid entering compressor chamber 151 as it fills. In order to assure this equality of mass flow rates, the area of piston head 160 relative to the area of piston head 182 is preferably equal to the relative density of the working fluid in compression chamber 151 to the density of working fluid in buffer chamber 154. The arrows in FIG. 4 illustrate the flow at such a representative point in the down stroke phase of the cycle.

Thus, achieving substantially isobaric filling of compression chamber 151 on the down stroke of the engine cycle is aided by the connection through shunt channel 100 between buffer chamber 154 and an outlet duct 105 leading from the outlet of expander chamber 162 through outlet valve 104.

Valve Phasing of Fully Automatic Valves

Figure 7:
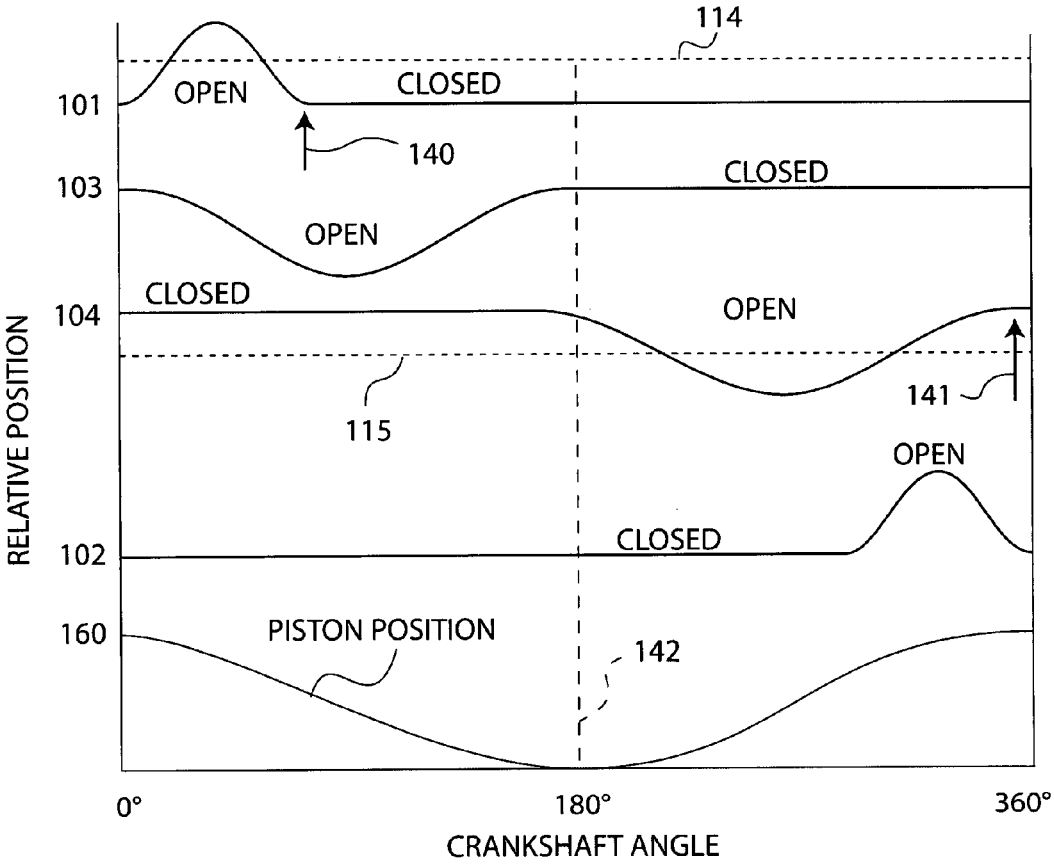
FIG. 7 is a graph showing the valve lifts and piston position of the harmonic engine of FIG. 4 as a function of crankshaft angle. A horizontal dashed line indicates the neutral position, corresponding to a fully relaxed spring, for each of the expander valves.

A detailed timing diagram illustrating the phasing of the motions of fully automatic valves 101, 102, 103, and 104 together with the position of piston 160, is shown in FIG. 7, as a function of crankshaft angle on the abscissa. The sequencing and conditions described here are those for the nominal, full power, steady operation with a highly compressible gaseous working fluid, and the ordering of the valve curves from top to bottom in the figure is approximately in the order of their opening. The angular range displayed covers one complete 360° cycle, and starts at a point for which piston head 160 is at its uppermost position, TDC, "top dead center". At this point, inlet valve 101 opens up out of expansion chamber 162, while all other valves are closed. High pressure, high temperature gas, entering through inlet valve 101, fills expander chamber 162 and produces a force that drives piston head 160 downwards, expelling the gas in buffer chamber 154, forcing gas into compressor chamber 151 through valve 103, and in addition driving piston head 182 downwards to deliver net work to crankshaft 186.

After undergoing a full cycle of oscillation about neutral position 114, located above and outside cylinder 161, inlet valve 101 returns to its seat and is latched closed. This event is indicated by arrow 140 in FIG. 7. The phasing of this valve closure effectively determines the peak pressurization ratio of the engine, with longer valve opening corresponding to lower pressurization. By an appropriate choice of spring constant for spring 107, in conjunction with the mass of inlet valve 101, and accounting for the slowing effects of friction and the speeding up effects of the in-rushing gas, the period of the valve motion is made equal to the design open time (in the case shown here this is approximately one quarter of the full engine period). As piston head 160 continues to move downwards after inlet valve 101 has closed, the gas in chamber 162 expands, and drops in pressure.

Somewhat after the TDC point, and as the pressure in compressor chamber 151 has dropped sufficiently below that at the exit of the cooler, automatic valve 103 opens and allows working fluid to flow into the compressor. This event, for a typical design choice, happens shortly after inlet valve 101 has opened. After valve 103 has opened, as piston heads 160 and 182 descend, although the volume of gas expelled from buffer 154 is greater than the volume of working fluid forced into compressor chamber 151, since the temperature of the working fluid drops, and the density of the working fluid increases as it passes through cooler 187, the pressure at the inlet to compressor 190 is prevented from dropping significantly.

As piston head 160 reaches "Bottom Dead Center", BDC, and begins to turn around and travel upward, automatic valve 103 closes and outlet valve 104 opens. This point in the cycle is indicated in FIG. 6 by dashed vertical line 142. Under steady running conditions, as the piston head reaches BDC, the pressure in chamber 162 is nearly equal to the pressure on the opposite side of outlet valve 104, so that the force of spring 106, combined with the differential pressure force, is sufficient to disengage latch 112 from detent 113 and push outlet valve 104 into cylinder 161. After opening at BDC, outlet valve 104 undergoes a single cycle of harmonic oscillation about neutral position 115, located inside cylinder 161, and latches closed at the point indicated by arrow 141. The timing of the closure of outlet valve 104 is determined by the choice of spring constant and valve mass, as described for the case of the expander inlet valve, but in the case of outlet valve 104 this open time is approximately one half of the full engine period. After outlet valve 104 closes, the pressure in the expander chamber rapidly increases as piston head 160 approaches TDC.

At the point that the pressure of the working fluid in compression chamber 151 sufficiently exceeds the pressure of the working fluid on the opposite side of automatic valve 102, valve 102 is forced open, and working fluid in chamber 151 is expelled to high pressure conduit 158. Under steady running conditions valve 102 remains open just long enough to expel the steady state equilibrium mass charge per cycle of working fluid from chamber 151. In the case of working fluid that is condensed to liquid phase by the cooler, the opening of valve 102 occurs instead very shortly after BDC, by virtue of the low degree of compressibility of most liquid working fluids.

As piston head 182 comes to TDC, valve 102 closes, as the outward flow of working fluid, and the pressure drop across valve 102 ceases. Under normal, steady operating conditions, the pressure in the compressor chamber is then at the high pressure point. At a point very near TDC, for which the pressure in the expander chamber has increased sufficiently closely to the pressure on the opposite side of inlet valve 101, the force of spring 107 combined with the pressure differential force across inlet valve 101 becomes sufficient to disengage latch 109 from detent 110, and inlet valve 101 is released. At this time a full cycle has completed, and the next cycle begins.

It is appreciated that other resonance multiples are feasible for the automatic valve operation. For example, the period of the expander inlet valve could be one-third that of the expander piston head, rather than one-quarter, and the phase delay between TDC and the closing of valve 101, indicated by arrow 140 in FIG. 7 made 120° rather than 90°. For such larger phase delay cases, the pressure ratio between the high pressure and low pressure conduits would be lower than in the case described above. Similarly, smaller fractional periods would correspond to smaller phase delays and higher pressure ratios. It is, however, quite helpful for the period of the expander inlet valve to be close to an integer fraction of the engine period, in order to facilitate the process of starting the engine.

Furthermore, for fully automatic expander valve operation, it is particularly advantageous that the pressure pulsations produced at the outlet of the compressor arrive at the inlet to the expander with an optimal phase delay, approximately 90° for the timing diagram shown in FIG. 7. With this delay, the pressure pulse produced at the outlet of compressor 190 during the open phase of valve 102 arrives at the inlet to expander 150 during the open phase of inlet valve 101. In the tandem embodiment illustrated in FIG. 4, in which the expander and compressor pistons necessarily move in phase, this phase delay is produced by providing that high pressure conduit 158 has a total length, from compressor outlet to expander inlet, substantially equal to one quarter acoustic wavelength at the design engine frequency. It is also preferable for high pressure conduit 158 to have smooth bends and avoid sudden discontinuities, such as illustrated in FIG. 5, in order to minimize sonic reflections.

Similarly, it is advantageous for the pressure pulsations produced at the outlet of the expander to arrive at the inlet to the compressor with an optimal phase delay. In the embodiment shown in FIG. 4, the strongest pressure pulses that pass from the expander to the compressor occur on the down stroke, with outlet valve 104 closed. Thus the phase delay in this case may advantageously be either 0° or some integer multiple of 360°.

The fully automatic valve embodiment is particularly well suited for an engine designed to operate at a single speed, such as is desirable for a prime mover for the generation of alternating current at a fixed frequency, such as 60 Hz in the United States, or 50 Hz in Europe. Depending on the number of poles in the electrical generator, the electrical frequency may be any desired integer factor higher than the design engine frequency. This harmonic resonance with the operating frequency of induction motor generator 188 is particularly helpful in the startup of the engine discussed below.

Startup of Fully Automatic Expander Valves

With regard to the fully automatic expander valve embodiment, FIG. 6 shows an initial state prior to engine startup for which the expander piston head is not near TDC and the valves 101 and 104 are in their respective neutral positions. With both the expander inlet and outlet valves normally open at their equilibrium positions, there is little resistance to the acceleration of the starter motor generator 188, and with the connection of motor 188 to a source of AC electrical power, crankshaft 186 is rapidly brought up to the unloaded operating speed for motor 188. Since this speed is by design in harmonic resonance with the valves, they oscillate with increasingly greater amplitudes, until they reach the full amplitude and phase indicated in FIG. 7, and operate as described above for the steady running condition.

As the engine turns over, a temperature gradient begins to build up in the interchanger from top to bottom. In the startup phase, more heating is required than in the steady state condition at the same operating frequency, since most of the heating of the working fluid occurs in the heater, rather than in the interchanger. Once the temperature distribution in the interchanger has reached its steady state, the engine also reaches its steady running state.

Pressure Reference and Power Variation

In a closed cycle embodiment, as known in the art, varying the pressure of the working fluid contained within the engine fluidic circuit varies the power output from the engine. Such a power control system is described in U.S. Pat. No. 3,708,979 to Bush, for example. As the pressure in the engine circuit is increased or decreased, to good approximation, assuming constant speed operation and fixed throttle settings, so to does the engine power output increase or decrease proportionally. Pressure reference assembly 166 in the closed cycle embodiment comprises this power control system. FIG. 4 shows an implementation of such a system, in which high pressure reservoir 172 is connected through valve 175, and low pressure reservoir 173 is connected through valve 176 to low pressure conduit 157. Pump 174 keeps the pressure in reservoir 173 low and the pressure in reservoir 172 high. Pressure control actuator 177 on command from controller 197, opens valve 175 momentarily to increase the engine pressure and thereby increase power or opens valve 176 momentarily to reduce the engine pressure and thereby decrease power.

It is appreciated that the pressure reference assembly 166 in an open cycle embodiment may be nothing more than a port to the ambient atmosphere through a dust filter (not shown) with the ambient atmosphere itself serving the role of low pressure reservoir 173.

Temperature Accommodation and Speed Regulation by Throttles

FIG. 4 also shows a throttle valve 196 which is varied by actuator 194 in response to controller 197 based on changes in the ratio of the hot temperature sensed at the exit of expander 150 by thermocouple 153, to the cold temperature sensed at the inlet to compressor 190 by thermocouple 152. Partially closing throttle valve 196 produces a drop in the pressure admitted to the compressor relative to pressure reference 166. It is found by numerical models that the net power output of the engine illustrated in FIG. 4 varies almost not at all with changes in the pressure drop across compressor inlet throttle 196, for a fixed pressure at pressure reference 166, but varies approximately linearly with the pressure drop across expander outlet throttle 199. Thus, the setting of throttle 196 is used to accommodate variations in the hot to cold temperature ratio between the expander outlet and compressor inlet, while the setting of throttle 199 is used for power demand accommodation (in the open cycle case in which pressure reference 166 is fixed at the value of the ambient atmospheric pressure) or speed regulation (in the closed cycle case, in which pressure reference 166 may accommodate power demands for a given fixed speed). It is useful to be able to tolerate rapid changes in the volumetric expansion ratio between the compressor and the expander, especially in the context of a solar powered engine, in which the temperature produced at the heater by solar illumination may vary substantially with the fluctuating solar insulation conditions from minute to minute, or in which the temperature produced at the cooler may vary with the ambient wind speed or temperature. This is in contrast to the case of a conventional external combustion engine, for which the temperature of the heater is generally thermostatically controlled.

Semi-Automatic Expander Valves

In an alternative embodiment, semi-automatic expander valves may be employed for controlling the flow of working fluid into and out of the expansion chamber of the expander assembly. In contrast to the fully-automatic valve embodiment where both the unlatching and re-engagement of the valve occur automatically in response to a changing pressure differential, semi-automatic operation employs an actively controlled mechanism for releasing the expander valves from their latched positions, while the return mechanism for re-engaging the latch remains automatic, with a period determined by the resonant frequency of the spring strength and valve mass combination. It is appreciated that suitable mechanical, electrical, or pneumatic means known in the art, such as camshaft driven valve lifters, pneumatic valve actuators, or solenoid driven valve actuators, for example, may be used as the actively controlled release mechanisms of the semi-automatic valves, as well as for use in conjunction with the other aspects of the present invention not necessarily involving expander valve operation.

Figure 8:
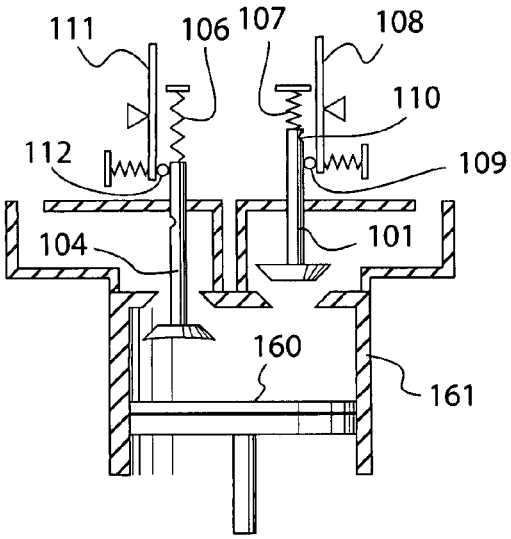
FIG. 8 is a detail view of the semi-automatic embodiment of the expander inlet and outlet valves both in the un-latched configuration.
Figure 9:
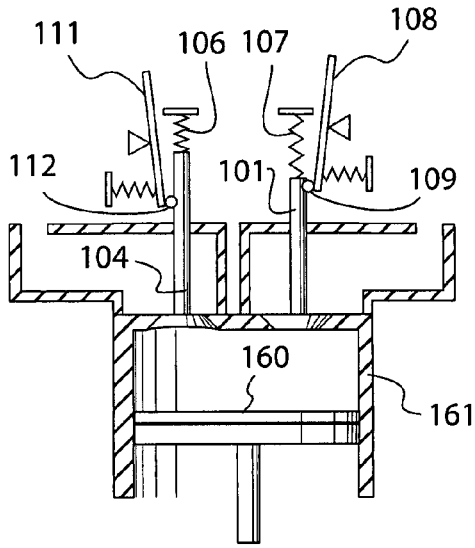
FIG. 9 is a detail view of the semi-automatic embodiment of the expander inlet and outlet valves both in the latched configuration.

FIGS. 8 and 9 show an exemplary embodiment of the semi-automatic expander valves of the present invention having release lever 108 associated with inlet valve 101, and release lever 111 associated with outlet valve 104. Latch 112 is preferably released by latch release lever 111 at a predetermined engine phase near BDC, rather than in response to the diminishing pressure differential. When pressed as shown in FIG. 8, latch release lever 111 releases latch 112 and allows outlet valve 104 to commence oscillation. Latch 112 is re-engaged as piston head 160 and outlet valve 104 approach TDC as in the fully automatic case. Similarly, latch 109 is released by latch release lever 108 as piston head 160 approaches TDC rather than in response to the pressure spike as piston head 160 reaches TDC. When pressed, release lever 108 releases latch 109 from a catch 110 and causes inlet valve 101 to commence oscillation under the combined force of spring 107 and the aerodynamic force of the working fluid flow past inlet valve 101.

As in the fully automatic mode, the oscillation period of spring 106 and outlet valve 104 in the face of the out rushing working fluid should be just under half the design engine period. Also as in the fully automatic mode, the oscillation period of spring 107 and inlet valve 101 in the face of the in rushing working fluid determines the engine pressurization ratio in normal operation. For ease of starting, it is desirable for the frequency of inlet valve 101 to be near an integer multiple of the engine frequency. The exemplary timing illustrated in FIG. 7 corresponds to a factor of four between the frequency of inlet valve 101 and the engine frequency.

Reed Valves and Linear Motor/Generator

FIG. 10 schematically illustrates another exemplary harmonic engine system which uses reed valves instead of poppet valves as the automatic harmonic oscillator valves, and a linear induction motor/generator 388 instead of a conventional crank assembly. In this case, the oscillating functionality provided by the discrete springs used with the poppet valves in FIGS. 4 and 5 may be provided instead by the flexibility and resiliently biasing properties of the reeds themselves. In particular, FIG. 10 shows a reed valve 301 positioned at the inlet of expander 350, a reed valve 304 positioned at the outlet of the expander, a reed valve 303 at the inlet of compressor 390, and a reed valve 302 at the outlet of the compressor. The state shown in FIG. 10 corresponds to the fully relaxed state for all four reed valves. As can be seen, the expander valves are in their relaxed state while open, in contrast to the compressor valves, which are closed in their fully relaxed state. Furthermore, the expander inlet reed valve 301 is shown positioned outside the expansion chamber to occlude from the outside in, and the expander outlet reed valve 304 is positioned inside the expansion chamber to occlude from the inside out.

The timing of the expander valves in this embodiment is similar to that shown in FIG. 7 for the case with fully automatic poppet valves, while the timing of the compressor valves is shifted by 180° by virtue of the inverted orientation of the compressor with respect to the arrangement in FIG. 4. As with the poppet valve embodiment, latch 309 serves in conjunction with the pressure differential, to hold valve 301 closed for the desired portion of the full engine cycle. FIG. 10 also illustrates that reed valve 304 may function without need of a latch, by virtue of the presence of piston head 360 tending to hold it closed near TDC until sufficient pressure differential has been produced, via the opening of valve 301 and the admission of high pressure working fluid to the expansion chamber, to hold valve 304 closed.

The length of high pressure conduit 358 in this case is preferably tuned to produce a phase delay of 270° between the pressure pulse delivered at the compressor outlet and the pressure pulse received at the expander inlet. With this tuning, the pressure pulse from the compressor arrives at the expander at the time that valve 301 is open.

Also illustrated in FIG. 10 is the use of a linear induction motor generator 388, rather than the crankshaft, flywheel and rotary induction motor shown in FIG. 4. Suitable devices for this application are commercially available, such as the STAR motor/alternator, for example, produced by the Clever Fellows Innovation Consortium (CFIC) corporation. Such devices may be used both for initially starting the engine as well as for extracting single-phase, 60 Hz alternating current electrical power from the engine.

Alternative System Configuration: Expander and Compressor in Parallel

FIG. 11 shows a sectional view of an alternative system configuration with a parallel arrangement of the compressor 290 and expander 250 cylinders linked by crankshaft 286. Since the phases of the motion of compressor piston head 282 and expander piston head 260 are not necessarily completely in step, as in either of the tandem arrangements shown in FIG. 4 or FIG. 10, the optimal time delay between the outlet of the compressor and the inlet of the expander may be arranged by having a combination of crankshaft phase difference, and pressure wave transit time generated phase difference based on total length of the fluidic conduit connecting the compressor outlet to the expander inlet. In the example displayed in FIG. 11, most of the desired 90° phase difference between the compressor and the expander is provided mechanically. This mechanical component of the 90° phase delay is independent of engine speed, in contrast to the propagating wave component of the phase delay.

The phasing of the motion of expander piston head 260, compressor piston head 282, and valves 201, 202, 203, and 204 in the normal, steady state operation of this embodiment is preferably as shown in FIGS. 12 and 13. By having the illustrated 90° phase delay of compressor piston head 282 with respect to expander piston head 260, so that the open period of valve 201 closely matches the open period of valve 202, the flow of the working fluid from the compressor outlet to the expander inlet is as indicated by the arrows in FIG. 11. With this phasing, the header space of the engine described in U.S. Pat. No. 3,708,979 to Bush may be eliminated without producing significant undesirable pressure deviations in the volume between the outlet of valve 202 and the inlet of valve 201.

In this embodiment, automatic valve 204 acts without a latch in the following way. While the pressure inside expander chamber 162 is higher than the pressure at the outlet, valve 204 is held shut by the differential pressure overcoming the force of spring 106. As piston head 260 reaches BDC, and the force from the pressure differential across valve 204 becomes less than the spring force, spring 106 pushes valve 204 into the expander chamber. During the upstroke of piston head 260, valve 204 executes a full oscillation. Just at TDC, valve 204 returns to its closed position. As valve 204 closes, the pressure of the small quantity of working fluid left in expander chamber 162 rapidly increases as piston head 260 more closely approaches TDC. It is helpful for the head of valve 204 to be slightly concave, as shown in FIG. 11, in order to prevent the valve from being sucked back down with piston head 260 as it leaves TDC. The small concavity produces a small repelling gas spring, replacing the function of the latch of the first embodiment, between the bottom of valve 204 and the top of piston head 260 that helps keep valve 204 sealed shut as piston head 260 passes through the TDC position. Just after piston head 260 reaches TDC, with valve 201 open, the pressure within expansion chamber 162 remains high, and valve 204 is held closed until piston head 260 once again approaches BDC.

With respect to the means for driving the compressor, it is appreciated that rather than driving reciprocating compressor by crankshaft 286, as shown in FIG. 11, any other source of high pressure working fluid may be employed, as for example from a rotating compressor or pump, electrically driven by the output of generator 288. For example, a separate electric motor (not shown) having only an electrical connection instead of crankshaft 286 may drive the compressor. Indeed, even a simple source of compressed gas, as from a pressure vessel or other reservoir (not shown) may be used to supply the inlet to the expander.

FIG. 12 is a graph showing the compressor valve and compressor piston positions of the steady running, parallel embodiment of the harmonic engine illustrated in FIG. 11, with the compressor valve and compressor piston positions shown in solid lines, and with the expander piston position shown as a dashed line for reference. Dotted line 305 corresponds to the fully closed positions for each of the valves.

And FIG. 13 is a graph showing the expander valve and expander piston positions of the steady running, parallel embodiment of the engine of FIG. 11, with the expander valve and expander piston positions shown in solid lines, and the compressor piston position shown as a dashed line for reference.

Alternative System Configuration: Double Acting Expander

It is appreciated that the expander assembly of the present invention may be implemented in a double acting configuration 450, as shown in FIG. 14. In this case, the joint role of buffer chamber 154 and shunt channel 100 described in connection with FIG. 4 is instead served by having an additional expansion chamber 454 below the expander piston head. In addition, a second expander inlet valve 401 controls the admission of high pressure working fluid to lower expansion chamber 454, while a second expander outlet valve 404 controls the expulsion of low pressure working fluid from the lower expansion chamber. The operation of valve 401 is 180° out of phase with respect to the operation of valve 101, and similarly, valve 404 is 180° out of phase with respect to valve 104. In the double acting embodiment, the action of the expander valves may each be fully automatic, or semi-automatic, as described above. In the fully automatic embodiment, the strength of spring 407, together with the mass of valve 401 are chosen to provide the same resonant frequency as for valve 101. Similarly, the strength of spring 406, considering the mass of valve 404 is chosen to match the resonant frequency of valve 104. By this choice of design, the timing of latch 409 is then 180° out of phase with latch 109, but otherwise acts in an identical fashion.

In the double acting embodiment described here, outlet manifold 405 experiences two pulses of emerging working fluid per engine cycle, and inlet manifold 425 preferably supplies two pulses of entering working fluid per engine cycle. This doubling of the pulsation rate of working fluid leads to a preference for the use of a corresponding double acting compressor (not shown).

It is appreciated that the return means previously described in the first embodiment as involving the flywheel may in this alternative embodiment be provided by the admission of high-pressure working fluid to the lower chamber 454 of cylinder 461.

It is further appreciated that a much greater expansion ratio of the working fluid may be achieved by utilizing multiple expander cylinders in series. Such compound expanders are well known in the art of reciprocating steam engines.

Alternative Mode of Operation as Refrigerator

It is also appreciated that the heat-powered engine may be operated as a refrigerator based on the reversed operation of the current invention, i.e. supply power and produce cooling. The engine described here may, with the supply of work, act as a refrigerator rather than an engine. In this case, the roles of the heater and cooler are reversed. Heat is rejected at the high temperature point and accepted at the low temperature point.

While particular operational sequences, materials, temperatures, parameters, and particular embodiments have been described and or illustrated, such are not intended to be limiting. Modifications and changes may become apparent to those skilled in the art, and it is intended that the invention be limited only by the scope of the claims.

I claim:

1. An engine comprising:

a reciprocating-piston expander comprising: an expander cylinder; an expander piston head axially slidable in said expander cylinder and together enclosing an expansion chamber; a piston rod connected at one end to the expander piston head; an inlet valve for controlling the flow of working fluid into the expansion chamber to effect a power stroke of the expander, said inlet valve being a harmonic oscillator having an equilibrium position outside the expansion chamber so that the inlet valve is open at equilibrium and displaceable to a closed position against an equilibrium restoring force; latch means for automatically re-latching the inlet valve in the closed position after being unlatched to experience a harmonic oscillation; an outlet valve for controlling the flow of working fluid out from the expansion chamber during a return stroke of the expander, said outlet valve being a harmonic oscillator having an equilibrium position inside the expansion chamber so that the outlet valve is open at equilibrium and displaceable to a closed position against an equilibrium restoring force; an intake header connectable to a pressurized fluid source for channeling pressurized working fluid into the expansion chamber via the inlet valve; and an exhaust header for channeling working fluid exhausted out from the expansion chamber via the outlet valve; and periodic return means for effecting the return stroke of the expander after each power stroke.

2. The engine of claim 1, wherein the latch means is capable of being unlatched by a predetermined pressure differential on opposite sides of said inlet valve.

3. The engine of claim 1, wherein the latch means includes means for unlatching said latch means by an external trigger.

4. The engine of claim 1, further comprising:

second latch means for automatically re-latching the outlet valve in the closed position after being unlatched to experience a harmonic oscillation.

5. The engine of claim 4, wherein at least one of the first latch means and the second latch means is capable of being unlatched by a predetermined pressure differential on opposite sides of the respective inlet or outlet valve.

6. The engine of claim 4, wherein at least one of the first latch means and the second latch means includes means for unlatching the respective first or second latch means by an external trigger.

7. The engine of claim 1, wherein the inlet and outlet valves are spring-loaded poppet valves, with the inlet poppet valve having a chamfered edge capable of occluding from the outside in, and the outlet poppet valve having a chamfered edge capable of occluding from the inside out.

8. The engine of claim 1, wherein the inlet and outlet valves are reed valves, with the inlet reed valve positioned outside the expansion chamber to occlude from the outside in, and the outlet reed valve positioned inside the expansion chamber to occlude from the inside out.

9. The engine of claim 1, wherein said expander cylinder encloses a cylindrical volume, said expander piston head divides the cylindrical volume into the enclosed expansion chamber and an enclosed buffer chamber, and said piston rod axially extends out from the expander cylinder through a closed end thereof; and wherein the expander further comprises a shunt channel fluidically connecting the buffer chamber to the exhaust header so that, upon operating said outlet valve to exhaust working fluid from the expansion chamber, the expansion chamber and the buffer chamber are in fluidic communication.

10. The engine of claim 1, further comprising: a compressor as the pressurized fluid source having a compression chamber, a compressor inlet leading into the compression chamber, and a compressor outlet leading out from the compression chamber; and a fluidic channel connecting the compressor outlet to the intake header of the expander for supplying pressurized working fluid thereto.

11. The engine of claim 10, further comprising: a heater for heating the pressurized working fluid supplied by the fluidic channel from the compressor.

12. The engine of claim 10, further comprising: a cooler for cooling working fluid to be entered into the compressor.

13. The engine of claim 10, further comprising: a heat interchanger for heating the pressurized working fluid supplied by the fluidic channel from the compressor using heat from working fluid exhausted from the exhaust header of the expander.

14. The engine of claim 10, further comprising: a heater for heating the pressurized working fluid supplied by the fluidic channel from the compressor; a cooler for cooling working fluid to be entered into the compressor; and a heat interchanger for heating the pressurized working fluid supplied by the fluidic channel from the compressor using heat from working fluid exhausted from the exhaust header of the expander.

15. The engine of claim 10, further comprising: throttle valve means for controlling the flow rate of working fluid entering the compressor based on an absolute temperature ratio of the working fluid leaving the expander and the working fluid entering the compressor.

16. The engine of claim 1, further comprising: throttle valve means for controlling the flow rate of working fluid coming from the exhaust header of the expander.

17. The engine of claim 10, wherein the engine is an open circuit system with the exhaust header of the expander leading working fluid exhaust out to the ambient environment, and the compressor drawing in working fluid from the ambient environment.

18. The engine of claim 10, wherein the engine is a closed circuit system further comprising a second transport channel fluidically connecting the exhaust header to an inlet of the compressor for returning working fluid to the compressor.

19. The engine of claim 18, further comprising: pressure reference means connected to the second fluidic channel for controlling the pressure in the closed circuit engine.

20. The engine of claim 10, wherein the compressor is capable of generating a pulsating flow of pressurized working fluid to the expander.

21. The engine of claim 20, wherein the fluidic channel has a length which enables a pressure pulse produced at an outlet of the compressor to arrive at the inlet valve of the expander at the time of opening.

22. The engine of claim 20, wherein the compressor is a reciprocating-piston compressor comprising: a compressor cylinder, a compressor piston head axially slidable in said compressor cylinder and together enclosing a compression chamber, and inlet valve means for controlling the flow of working fluid into and out of the compression chamber.

23. The engine of claim 22, wherein the other end of the piston rod is connected to the compressor piston head to coaxially reciprocate the compressor piston head in tandem with the expander piston head so that the return stroke of the expander is out of phase with an intake stroke of the compressor.

24. The engine of claim 23, wherein said expander cylinder encloses a cylindrical volume, said expander piston head divides the cylindrical volume into the enclosed expansion chamber and an enclosed buffer chamber, and said piston rod axially extends out from the expander cylinder through a closed end thereof; and wherein the expander further comprises a shunt channel fluidically connecting the buffer chamber to the exhaust header so that, upon operating said outlet valve to exhaust working fluid from the expansion chamber, the expansion chamber and the buffer chamber are in fluidic communication.

25. The engine of claim 20, wherein the compressor is detached from and arranged to operate in parallel with the expander.

26. The engine of claim 25, wherein the compressor is a reciprocating-piston compressor comprising: a compressor cylinder, a compressor piston head axially slidable in said compressor cylinder and together enclosing a compression chamber, an inlet valve for controlling the flow of working fluid into the compression chamber via the compressor inlet, and an outlet valve for controlling the flow of working fluid out of the compression chamber via the compressor outlet.

27. The engine of claim 26, wherein the fluidic channel has a length substantially equal to one quarter acoustic wavelength at a predetermined engine frequency, so that a pressure pulse produced at an outlet of the compressor arrives at the inlet valve of the expander in phase with the opening of the inlet valve.

28. The engine of claim 26, wherein said expander cylinder encloses a cylindrical volume, said expander piston head divides the cylindrical volume into the enclosed expansion chamber and an enclosed buffer chamber, and said piston rod axially extends out from the expander cylinder through a closed end thereof; and wherein the expander further comprises a shunt channel fluidically connecting the buffer chamber to the exhaust header so that upon operating said outlet valve to exhaust working fluid from the expansion chamber, the expansion chamber and the buffer chamber are in fluidic communication.

29. The engine of claim 1, wherein the periodic return means for effecting the return stroke of the expander after each power stroke is a crank assembly having a crankshaft and a flywheel, and the piston rod is operably connected to the crankshaft so that the crankshaft is rotated by the reciprocation of the expander and the rotational inertia of the flywheel is transferred back to the expander.

30. The engine of claim 29, further comprising: an induction motor operably connected to the crankshaft and capable of drawing power from a power grid to initially drive the expander and compressor at startup, and supplying power back to the power grid once operational.

31. The engine of claim 1, wherein said expander cylinder encloses a cylindrical volume, said expander piston head divides the cylindrical volume into the first enclosed expansion chamber and a second enclosed expansion chamber, and said piston rod axially extends out from the expander cylinder through a closed end thereof; and wherein said periodic return means for effecting the return stroke of the expander after each power stroke comprises: a second inlet valve for controlling the flow of working fluid into the second enclosed expansion chamber to effect a second power stroke in an opposite direction of the first power stroke, said second inlet valve being a harmonic oscillator having an equilibrium position outside the second enclosed expansion chamber so that the second inlet valve is open at equilibrium and displaceable to a closed position against an equilibrium restoring force; latch means for automatically re-latching the second inlet valve in the closed position after being unlatched to experience a harmonic oscillation; a second outlet valve for controlling the flow of working fluid out from the second enclosed expansion chamber, said second outlet valve being a harmonic oscillator having an equilibrium position inside the expansion chamber so that the second outlet valve is open at equilibrium and displaceable to a closed position against an equilibrium restoring force.

32. An engine comprising:

a reciprocating-piston expander comprising: an expander cylinder enclosing a cylindrical volume; an expander piston head axially slidable in said expander cylinder and dividing the cylindrical volume into an enclosed expansion chamber and an enclosed buffer chamber; a piston rod connected at one end to the expander piston head and axially extending out from the expander cylinder through a closed end thereof; an inlet valve for controlling the flow of working fluid into the expansion chamber to effect a power stroke of the expander, said inlet valve being a harmonic oscillator having an equilibrium position outside the expansion chamber so that the inlet valve is open at equilibrium and displaceable to a closed position against an equilibrium restoring force; latch means for automatically re-latching the inlet valve in the closed position after being unlatched to experience a harmonic oscillation; an outlet valve for controlling the flow of working fluid out from the expansion chamber during a return stroke of the expander, said outlet valve being a harmonic oscillator having an equilibrium position inside the expansion chamber so that the outlet valve is open at equilibrium and displaceable to a closed position against an equilibrium restoring force; an intake header connectable to a pressurized fluid source for channeling pressurized working fluid into the expansion chamber via the inlet valve; and an exhaust header for channeling working fluid exhausted out from the expansion chamber via the outlet valve; and a shunt channel fluidically connecting the buffer chamber to the exhaust header so that, upon operating said outlet valve to exhaust working fluid from the expansion chamber, the expansion chamber and the buffer chamber are in fluidic communication;

periodic return means for effecting the return stroke of the expander after each power stroke;

a compressor as the pressurized fluid source having a compression chamber, a compressor inlet leading into the compression chamber, and a compressor outlet leading out from the compression chamber;

a fluidic channel connecting the compressor outlet to the intake header of the expander for supplying pressurized working fluid thereto;

first throttle valve means for controlling the flow rate of working fluid entering the compressor based on an absolute temperature ratio of the working fluid leaving the expander and the working fluid entering the compressor; and second throttle valve means for controlling the flow rate of working fluid coming from the exhaust header of the expander.

33. An engine comprising:

an expander having an expansion chamber, an expander inlet leading into the expansion chamber, an expander outlet leading out from the expansion chamber, valve means for controlling flow of working fluid into and out of the expansion chamber via the expander inlet and the expander outlet, respectively;

a compressor having a compression chamber, a compressor inlet leading into the compression chamber, a compressor outlet leading out from the compression chamber, and valve means for controlling flow of working fluid into and out of the compression chamber via the compressor inlet and compressor outlet, respectively;

a fluidic channel connecting the compressor outlet to the expander inlet for supplying pressurized working fluid from the compressor to the expander;

first throttle valve means for controlling the flow rate of working fluid entering the compressor inlet based on an absolute temperature ratio of the working fluid leaving the expander and the working fluid entering the compressor; and second throttle valve means for controlling the flow rate of working fluid coming from the exhaust header of the expander.

34. The engine of claim 33, wherein the engine is an open circuit system with the expander outlet leading working fluid exhaust out to the ambient environment and the compressor inlet drawing in working fluid from the ambient environment.

35. The engine of claim 33, wherein the engine is a closed circuit system further comprising a second fluidic channel connecting the expander outlet to an inlet of the compressor for returning working fluid to the compressor inlet.

* * * * *